US005407509A

United States Patent [19]

Ishizu et al.

[11] Patent Number: 5,407,509

[45] Date of Patent: Apr. 18, 1995

[54] PROCESS AND APPARATUS FOR PRODUCTION OF TOILET PAPER ROLLS HAVING NO CORE

[75] Inventors: Noboru Ishizu; Teruo Takahashi; Tomoyuki Shinohara, all of Iyomishima, Japan

[73] Assignee: Ishizu Machinery Co., Ltd., Japan

[21] Appl. No.: 240,367

[22] Filed: May 10, 1994

Related U.S. Application Data

[62] Division of Ser. No. 81,220, Jun. 25, 1993, Pat. No. 5,352,319.

[30] Foreign Application Priority Data

| | | | |
|---|---|---|---|
| Jul. 2, 1992 | [JP] | Japan | 4-175711 |
| Nov. 16, 1992 | [JP] | Japan | 4-305541 |
| Dec. 7, 1992 | [JP] | Japan | 4-326870 |
| Dec. 17, 1992 | [JP] | Japan | 4-086653 |
| Feb. 15, 1993 | [JP] | Japan | 5-025390 |

[51] Int. Cl.[6] ..... B65H 18/00

[52] U.S. Cl. ..... 156/184; 156/187; 156/191; 156/499; 242/530.1; 242/533; 242/594.3

[58] Field of Search ..... 156/184, 185, 187, 189, 156/191, 193, 446, 448, 449, 450, 499; 118/58, 264; 198/407; 242/594.3, 594.5, 530, 530.1, 532.3, 533, 541.2, 542

[56] References Cited

U.S. PATENT DOCUMENTS

| | | | |
|---|---|---|---|
| 3,125,478 | 3/1964 | Pratt | 156/184 X |
| 3,761,342 | 9/1973 | Richards et al. | 156/184 X |
| 3,951,890 | 4/1976 | Reilly et al. | 156/184 X |
| 4,487,378 | 12/1984 | Kobayashi | 242/67.1 R X |

*Primary Examiner*—James J. Engel
*Attorney, Agent, or Firm*—Lorusso & Loud

[57] ABSTRACT

Rolls of toilet paper are produced by winding a paper web around each of a plurality of air permeable cylindrical cores each having a fixed, outer diameter while applying a liquid to only a leading portion of each web so that wound webs each having a wet inner portion are formed. After drying the wound webs to integrally bind the inner portion, the core is separated from each of the wound webs. The above method is carried out using an apparatus including a winding device having a shaft to which the cylindrical cores are detachably fitted in a row, a drive device for rotating the cores supported by the shaft and to wind a paper web around each of the cores, an applying device for wetting only a leading portion of each to form a wet inner portion, a releasing device for releasing the wound web-bearing cores from the shaft to obtain arrays of the released, wound web-bearing cores, a drying device for drying the wet inner portion of each wound web, and a separating device for separating the wound webs from the cores.

5 Claims, 26 Drawing Sheets

PROCESS AND APPARATUS FOR PRODUCTION OF TOILET PAPER ROLLS HAVING NO CORE

This application is a division of U.S. Ser. No. 081,220 filed Jun. 25, 1993 now U.S. Pat. No. 5,352,319.

This invention relates to a process for the production of a bath room tissue roll having no core and to an apparatus useful for carrying out the process.

A bath room tissue (toilet paper) roll is generally composed of a paper core and a paper web of a predetermined length wound around the core. The use of such a core is, however, disadvantageous because it incurs costs. Further, it is necessary to collect the waste core, since the core cannot be flushed down the toilet.

To cope with this problem, there is proposed a toilet paper roll having no core. One known method for the production of such a core-free toilet paper roll uses an air-shaft which is radially inflatable and shrinkable. Thus, a plurality of toilet paper webs are wound around the common air shaft which has been inflated. In this case, a leading portion of each of the webs is wet with an aqueous solution of an adhesive so that the wound web has an inner portion adjacent to the shaft which is wet with the solution. As a result of this treatment, the inner portion of the toilet paper roll is integrally bound together to form a rigid, relatively hard layer having a circular cross-section. After the winding of the web, the shaft is shrunken to faciliate the removal of the shaft from the wound webs.

The above known method has a problem because the air shaft is expensive. Further, the shrinking of the shaft should be performed after the wet inner layer of the wound webs have been dried to the extent that the webs are no longer stick to the shaft. The drying requires 30–40 minutes so that it is necessary to use many, expensive air shafts in order to continuously perform the whole process.

The present invention has been made with the foregoing problems in the conventional method in view. In accordance with one aspect of the present invention there is provided a process for the production of a cylindrical roll of toilet paper having a predetermined length, comprising the steps of:

providing a cylindrical core having a fixed, outer diameter which is substantially the same as the inside diameter of said roll;

winding a continuous toilet paper web of said predetermined length around said cylindrical core while applying a liquid to only a leading portion of said web so that a first wound web having an inner portion adjacent to said core which is wet with said liquid is formed around said core;

then drying said wet, inner portion of said first wound web to integrally bind said inner portion and to obtain a second wound web around said core; and then separating said core from said second wound web.

In another aspect, the present invention provides a process for the production of a roll of toilet paper having a predetermined length, comprising the steps of:

providing a cylindrical core having a fixed, outer diameter which is substantially the same as the inside diameter of said roll;

winding a continuous toilet paper web of said predetermined length around said cylindrical core while applying a fusible powder adhesive to only a leading portion of said web to form a first wound web around said core, said first wound web having an inner portion adjacent to said core which bears said powder adhesive;

then heating said first wound web to fuse said powder adhesive and to integrally bind said inner portion, thereby forming a second wound web around said core; and then separating said core from said second wound web.

In a further aspect of the present invention, there is provided an apparatus for the production of rolls of toilet paper, comprising:

winding means having a shaft to which a plurality of coaxially aligned, cylindrical cores each having a fixed, outer diameter are detachably fitted, for winding a predetermined length of a continuous toilet paper web around each of said cores supported by said shaft;

means for wetting only a leading portion of said web such that the web wound around each of said core has a wet inner portion adjacent to said core;

means for releasing said plurality of wound web-bearing cores from said shaft such that the released, wound web-bearing cores remain coaxially arrayed;

drying means for receiving said arrayed, wound web-bearing cores released from said shaft and for drying said wet inner portion of the web wound around each of said cores; and separating means for separating said wound web having said dried, inner portion from each of said cores.

The present invention will now be described in detail below with reference to the accompanying drawings, in which.

Figure 1:
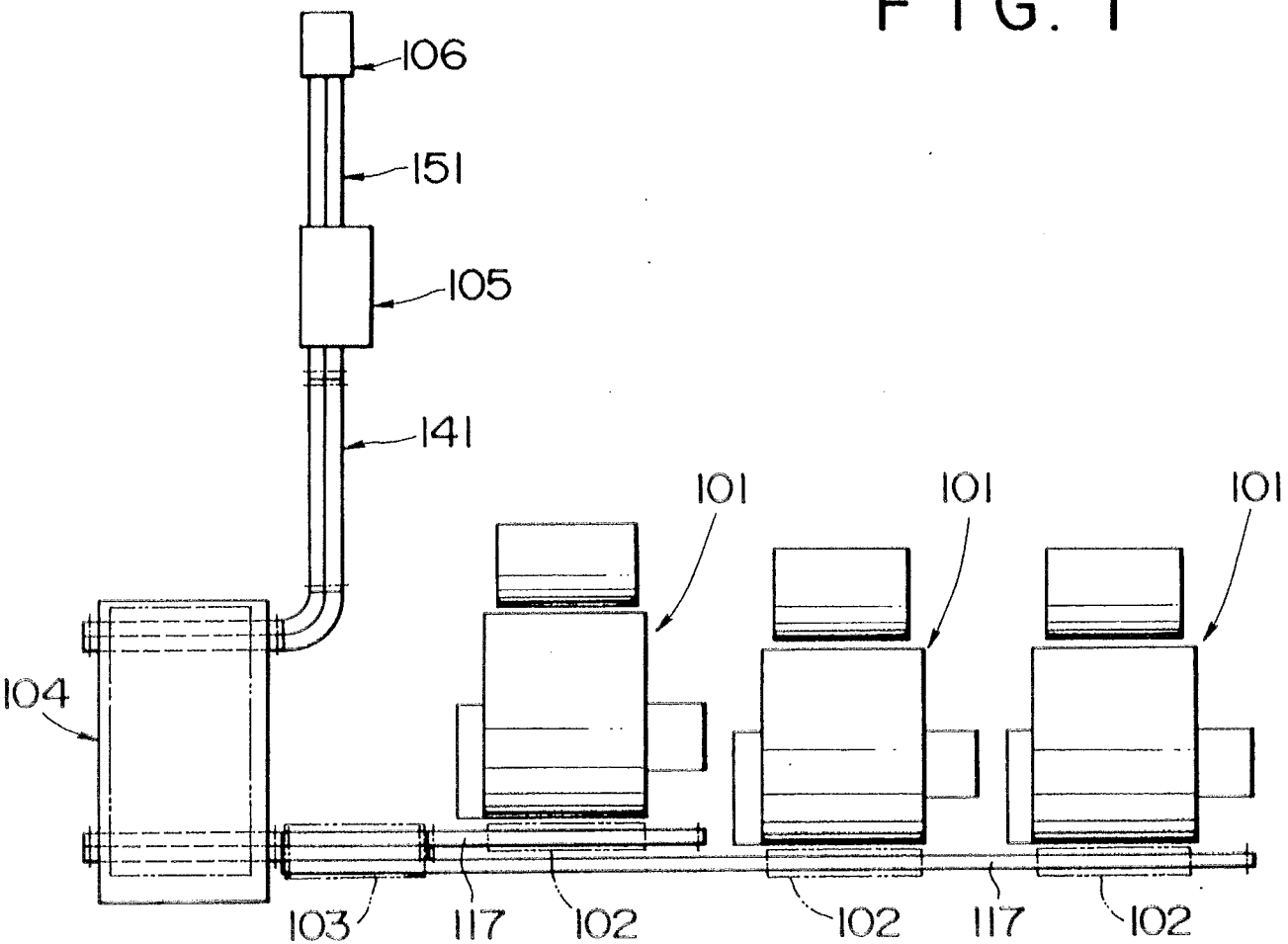
FIG. 1 is an elevational view diagrammatically showing a toilet paper roll manufacturing apparatus according to the present invention.
Figure 25:
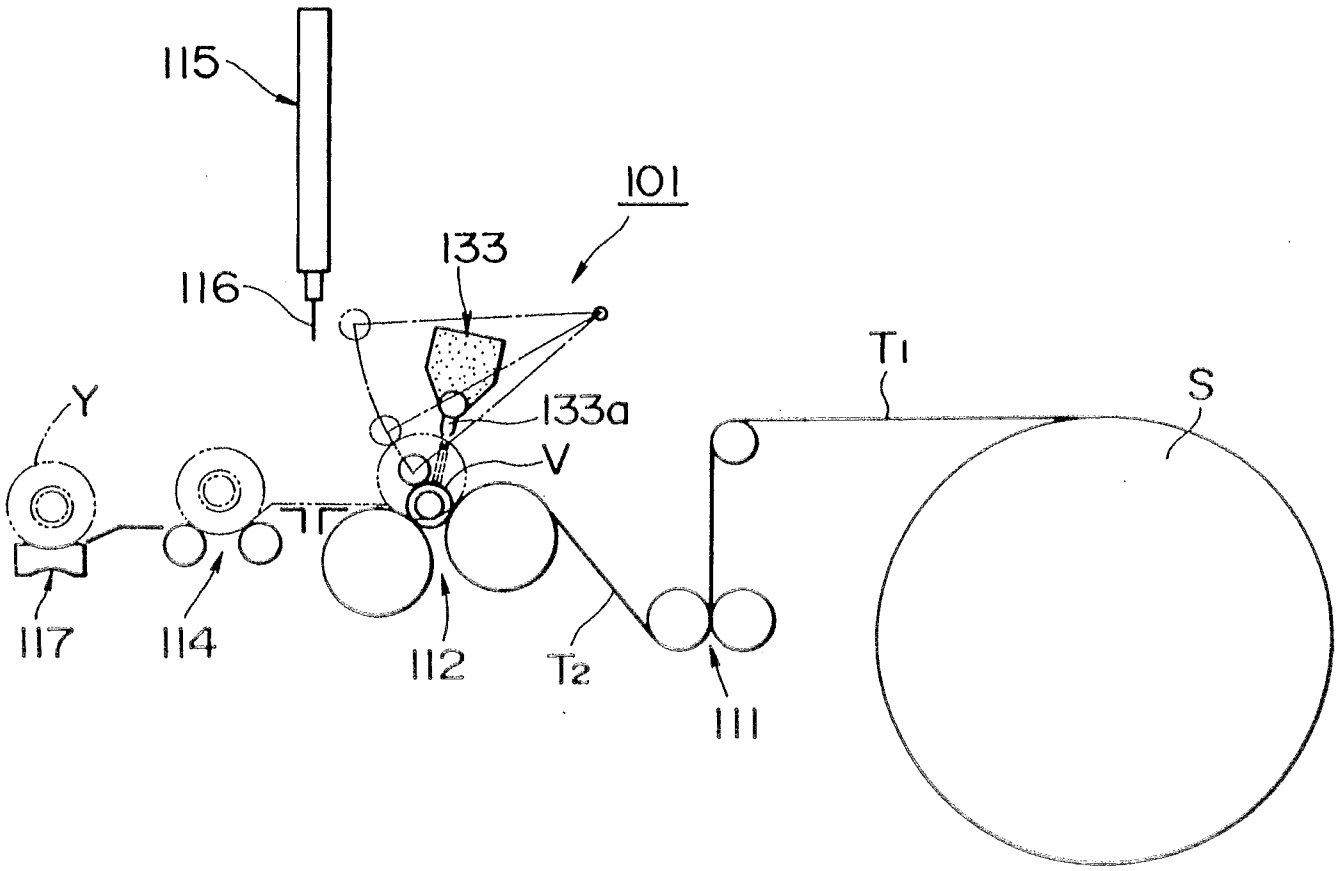
FIG. 25 is a side view, similar to FIG. 2, diagrammatically showing another embodiment of winding device of the apparatus of FIG. 1.

FIG. 1 schematically depicts the whole toilet paper roll production line according to the present invention, preferably operated in a fully automatic mode. Designated as 101 is a web winding device (three such web winding devices are provided in the illustrated embodiment) for winding a plurality of toilet paper webs of a predetermined length around cylindrical cores supported on a shaft while applying a liquid to a leading portion of the web. The shaft is removed in a succeeding separation device 102 and the wound web-bearing cores are conveyed by a conveyer 117 to a collecting zone 103 and delivered to a drying zone 104 where the inner region of the wound web wet with the liquid is dried. The dried web-bearing cores are then introduced into a separation zone 105 by a conveyer 141 where the cores are separated from the wound webs. The wound webs are conveyed by a conveyer 151 to a packaging zone 106 to obtain packs of core-free, toilet paper rolls. FIG. 25 is a schematic illustration of a toilet paper roll R obtained according to the present invention. The roll R has a central bore $R_1$ and an inner rigid region $R_2$ which was previously wet with the liquid and which has now been dried.

Figure 2:
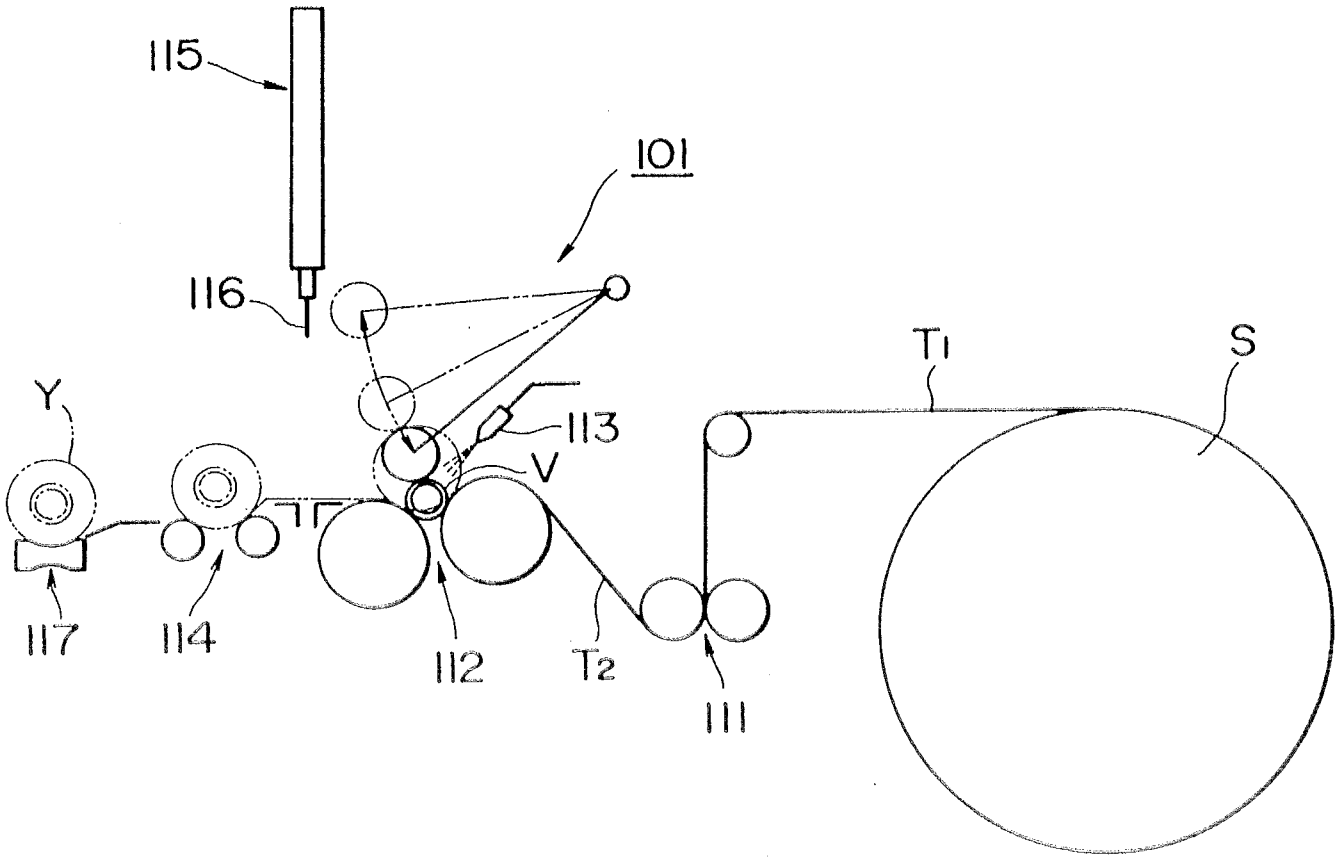
FIG. 2 is a side view diagrammatically showing a winding device in the apparatus of FIG. 1.

FIG. 2 illustrates an embodiment of the web winding device 101. A continuous raw material paper web $T_1$ is unwound from a roll S and longitudinally severed in a slitting device 111 into a plurality (for example, 16 strips) of webs $T_2$. The slit webs $T_2$ are wound in a winding section 112 around respective cylindrical cores supported on a common shaft.

Figure 3:
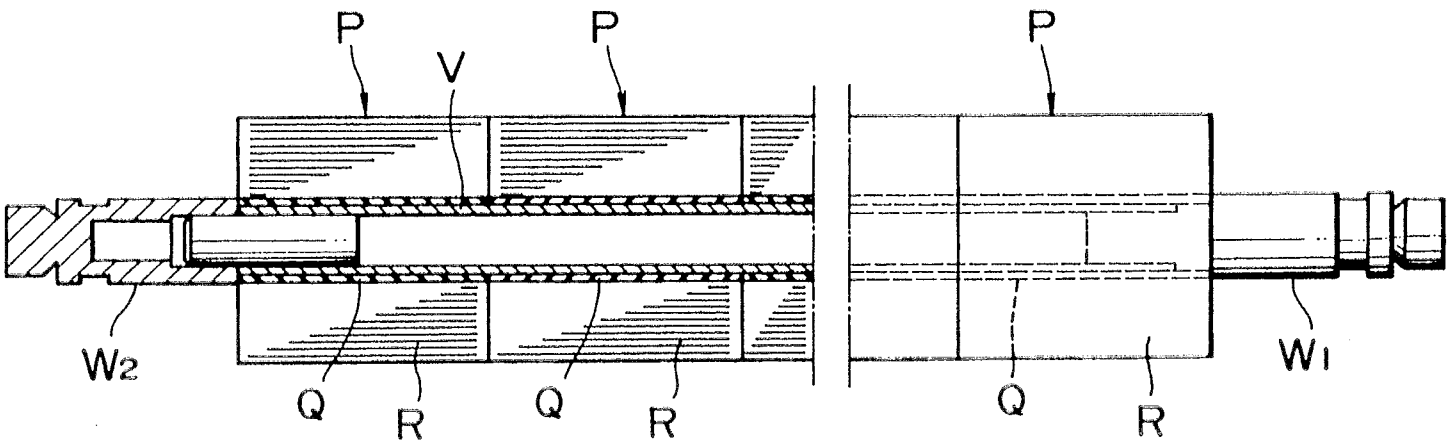
FIG. 3 is a partial, elevational view, cross-section in part, diagrammatically showing a plurality of paper webs wound around cylindrical cores secured to a shaft of the winding device of FIG. 2.

Referring to FIG. 3, designated as V is the shaft around which a plurality (for example 16) of cylindrical cores Q are detachably fitted for rotation therewith and fixed in positions by a pair of stopper caps $W_1$ and $W_2$. Alternatively, the cylindrical cores Q may be detachably and rotatably fitted to the shaft V, if desired. In this case, the cylindrical cores Q are prevented from moving in the axial direction and all of them are made rotatable together by the stopper caps $W_1$ and $W_2$. Thus, the cylindrical cores Q supported on the shaft V are integrally connected to each other by the caps $W_1$ and $W_2$.

Each of the cylindrical cores Q has a fixed outer diameter which is substantially equal to an inside diameter of the toilet paper roll to be prepared and which is generally in the range of 30–50 mm, and a central hole Q*a* (FIG. 4) into which the shaft V is fitted.

The cylindrical core Q is formed of a material which is not damaged or deformed upon contact with water and hot air, such as a metal, a synthetic polymer or wood. It is preferred that the cylindrical core Q have a slippery, smooth outer surface since the core Q is pulled out of the wound paper roll in a later stage. Formation of a coating of a releasing agent such as polytetrafluoroethylene over the outer surface of the core Q is desirable. It is also preferred that the cylindrical wall of the core Q be air permeable. Thus, a plurality of small perforations, preferably with a dameter of 0.2–5 mm are suitably formed throughout the cylindrical wall of the core Q. Alternatively, the cylindrical core Q may be formed of porous material having an open cellular structure. The core Q has generally a length substantially equal to the width of the paper to be wound therearound. In FIG. 3, designated as R is a wound web and as P is a wound web-bearing core consisting of the core Q and the wound web R formed therearound. The wound web-bearing cores P may be separated from the shaft V after detaching one or both caps $W_1$ and $W_2$ from the shaft V.

Referring again to FIG. 2, all of the axially aligned cores Q supported on the shaft V are simultaneously rotated as a unit together with the shaft V (or, if desired, independently from the shaft V) about the shaft V by any known suitable drive means to wind the toilet paper web $T_2$ around each of the cores Q. In the illustrated case, for example, the cores Q fitted to the shaft V are rotated by rolling contact with a common drive roll so that respective webs interposed therebetween are wound around the corresponding cores Q.

Means such as spray nozzles 113 are provided in the winding section 112 for spraying a liquid, such as water or aqueous adhesive solution, over only a predetermined length of the leading portion of the web such that the wound web R around each of the cores Q has a wet inner portion adjacent to the core Q.

Figure 4:
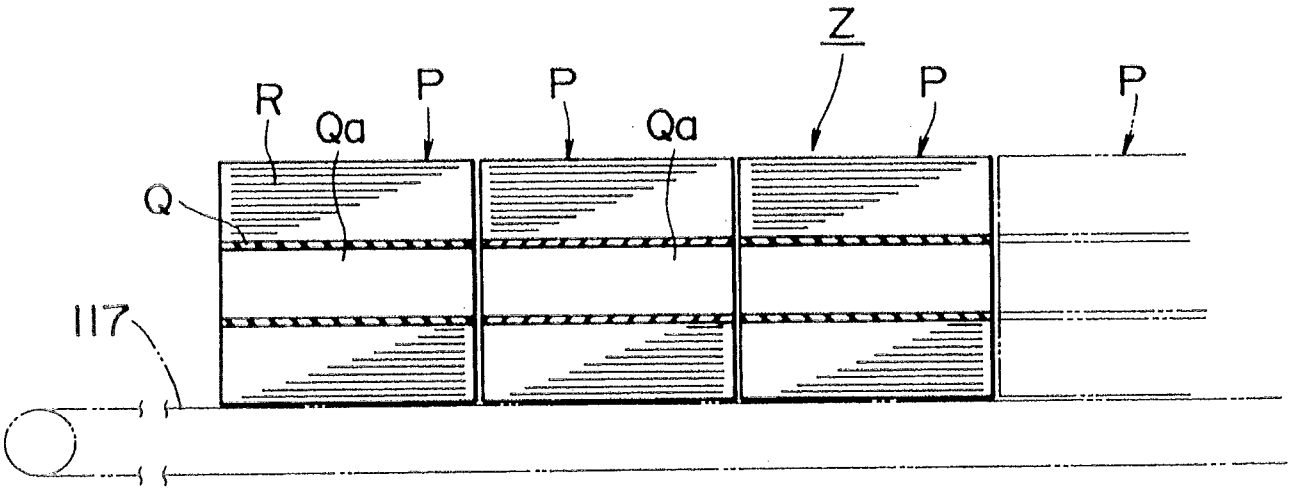
FIG. 4 is a partial, cross-sectional view showing an array of wound paper web-bearing cores.

After a predetermined length of the web $T_2$ has been wound around each of the cylindrical core Q, the winding section 112 stops the winding operation and the shaft V having the wound web-bearing cores P is displaced to a receiving section 114 where the trailing end of each of the wound webs is cut with a cutting blade 116 of a cutter 115 and is bonded to the wound web with an adhesive in any known manner. The resulting assembly Y which consists of the shaft V, the cores Q supported on the shaft v by stopper caps $W_1$ and $W_2$, and wound webs R formed around respective cores Q is displaced on the conveyer 117 and is introduced into the separating device 102 (FIG. 1) where one or both caps $W_1$ and $W_2$ are detached and the shaft V is pulled out of the assembly Y in any suitable manner to leave an array Z of wound web-bearing cores P as shown in FIG. 4.

As shown in FIG. 1, the arrayed, wound web-bearing cores P from respective winding devices 101 are collected in the collecting zone 103 and a desired number of arrays (for example 2 arrays) of such cores P are fed from the zone 103 to the drying zone 104 in any suitable manner. In the drying zone 104, the wet inner portion of the wound web R around each of the cores Q is dried so that the inner portion is integrally bound to form a relatively rigid tubular layer. When, for example, water is used as the liquid sprayed from the nozzles 113, hydroxyl groups of cellulose forming the adjacent layers of the web are bound together through hydrogen bonding and closely contacted with each other so that the web layers remain bound together upon being dried.

Figure 5:
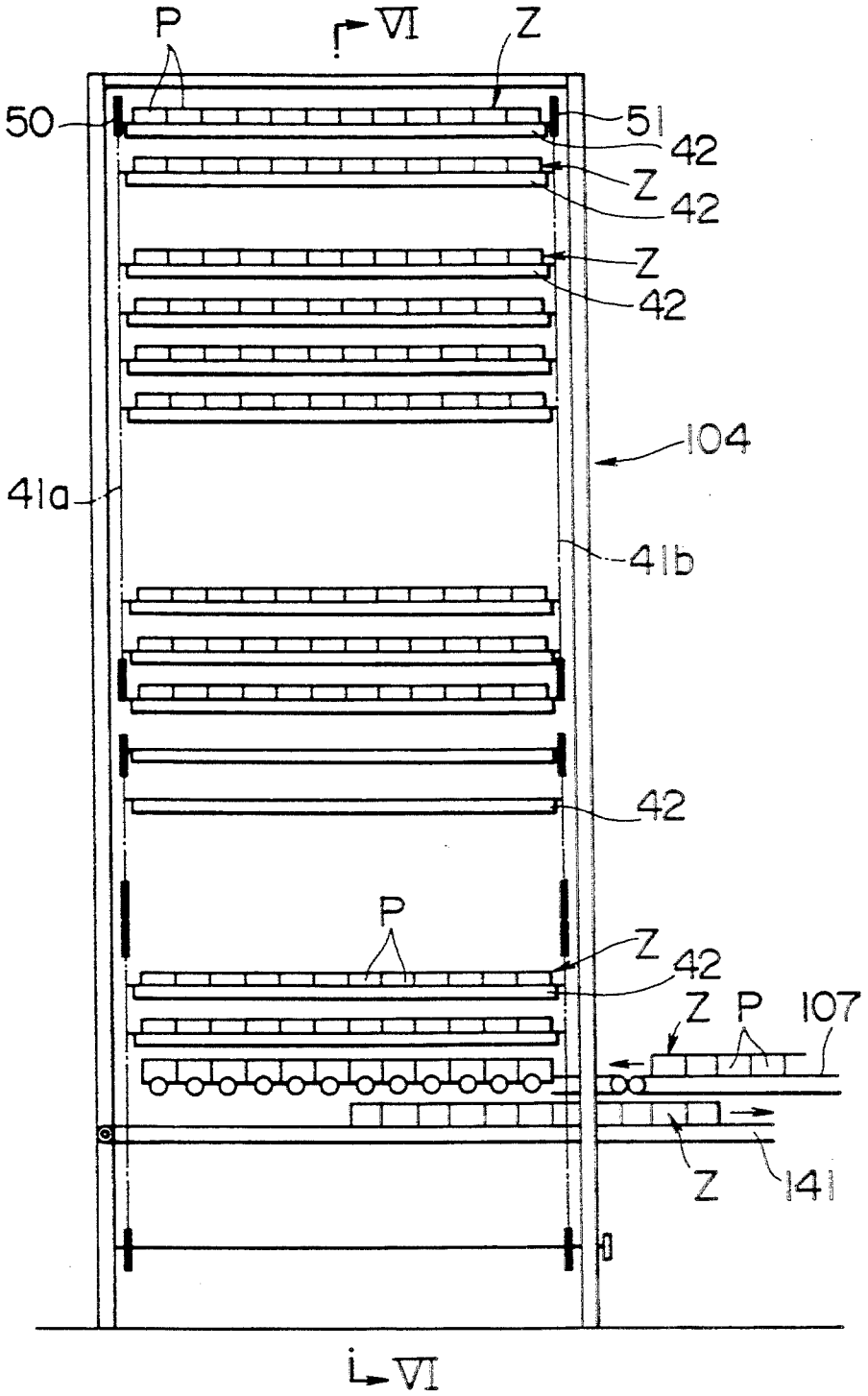
FIG. 5 is an elevational view showing one embodiment of drying device in the apparatus of FIG. 1.
Figure 6:
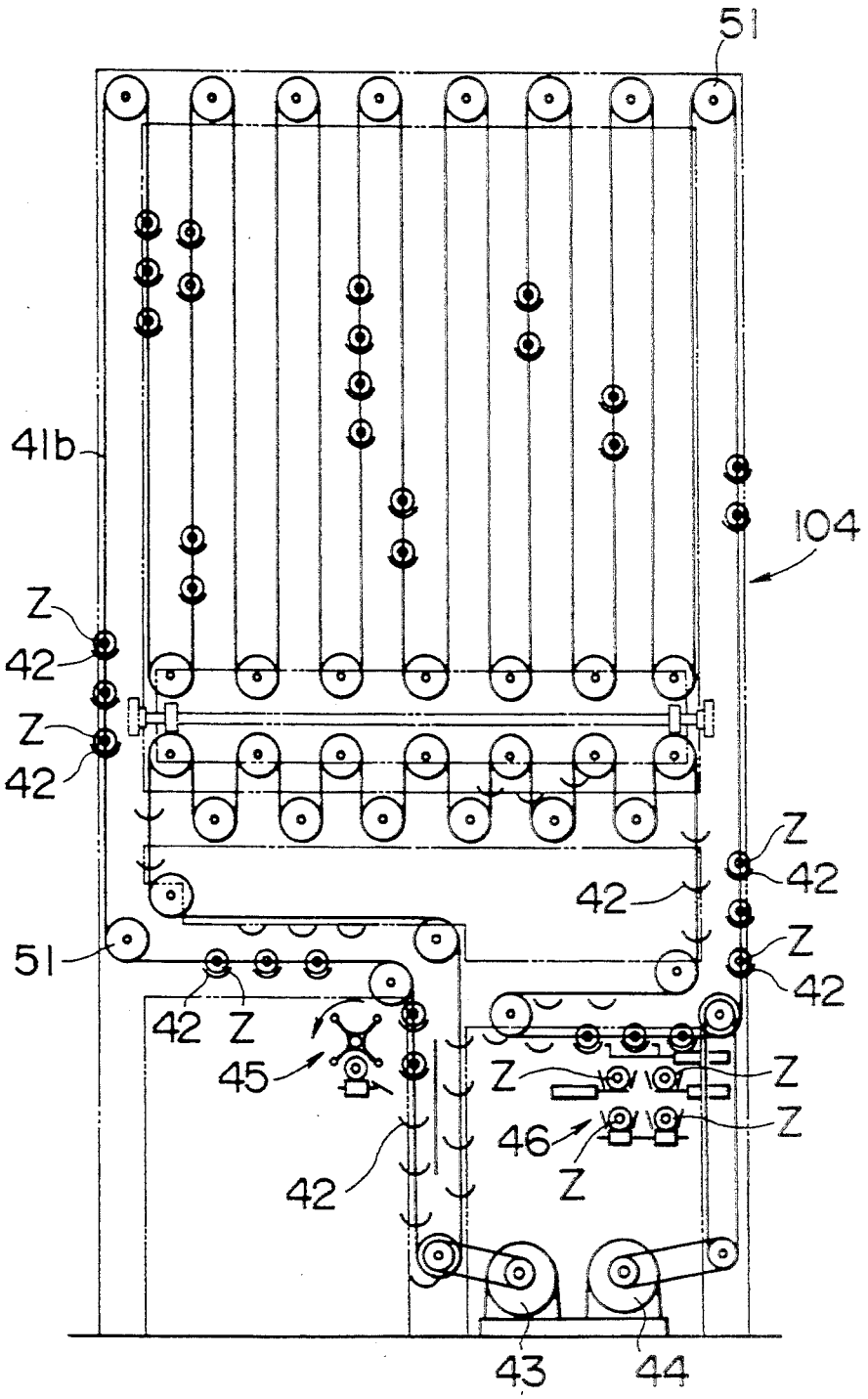
FIG. 6 is a sectional view taken along the line VI—VI in FIG. 5.

One example of the drying zone 104 is illustrated in FIGS. 5 and 6. In this embodiment, the array Z of the wound web-bearing cores P are conveyed by conveying means through a predetermined path. The conveying means includes a pair of spaced apart endless chains 41*a* and 41*b* supported by a plurality of opposing sprockets 50 and 51 in a meandering fashion. A multiplicity (for example, 200–300) of spaced apart U-shaped troughs 42 each shaped to support the array Z of the wound web-bearing cores P thereon are horizontally supported by the paired chains 41*a* and 41*b* for movement therewith.

Designated as 43 and 44 are motors for driving the endless chains 41*a* and 41*b*, i.e. the troughs 42, at a speed sufficient for the wet portion of each of the wound web-bearing cores P supported thereon to dry upon the travel of the cores through the path from a feed section 45 to a discharge section 46. In this case, the drying is performed to such a degree that the core Q may be smoothly removed from each of the wound web-bearing cores P in the subsequent separation zone 105 (FIG. 1). Thus, each array Z of the wet wound web-bearing cores P conveyed by a coveyer 107 from the collecting zone 103 is displaced on one of the troughs 42 in the feed section 45, while each array Z of the dried wound web-bearing cores P is delivered from each trough 42 to the conveyer 141 in the discharge section 46.

Figure 7:
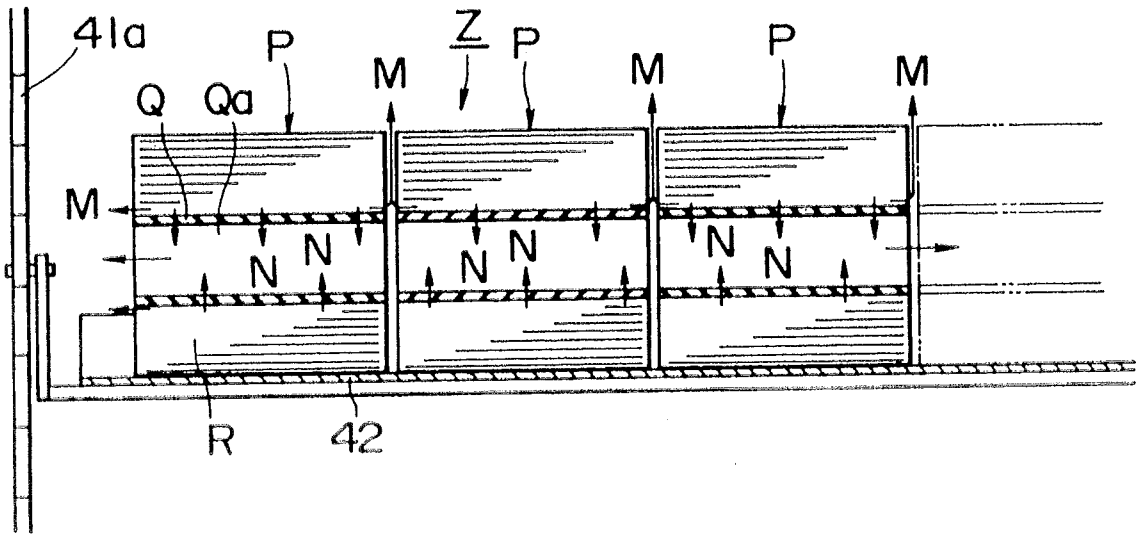
FIG. 7 is a partial enlarged view schematically showing the drying operation effected in the drying device of FIG. 5.

As shown in FIG. 7, when the cores Q are made from an air-permeable material, the drying of the inner wet portions $R_2$ (FIG. 26) of the wound webs R around respective cores Q is faciliated because the vapors of the liquid can pass not only along the arrows M through the narrow space between adjacent wound webs R but also along the arrows N through the center holes Q*a* of the cores Q.

Figure 10:
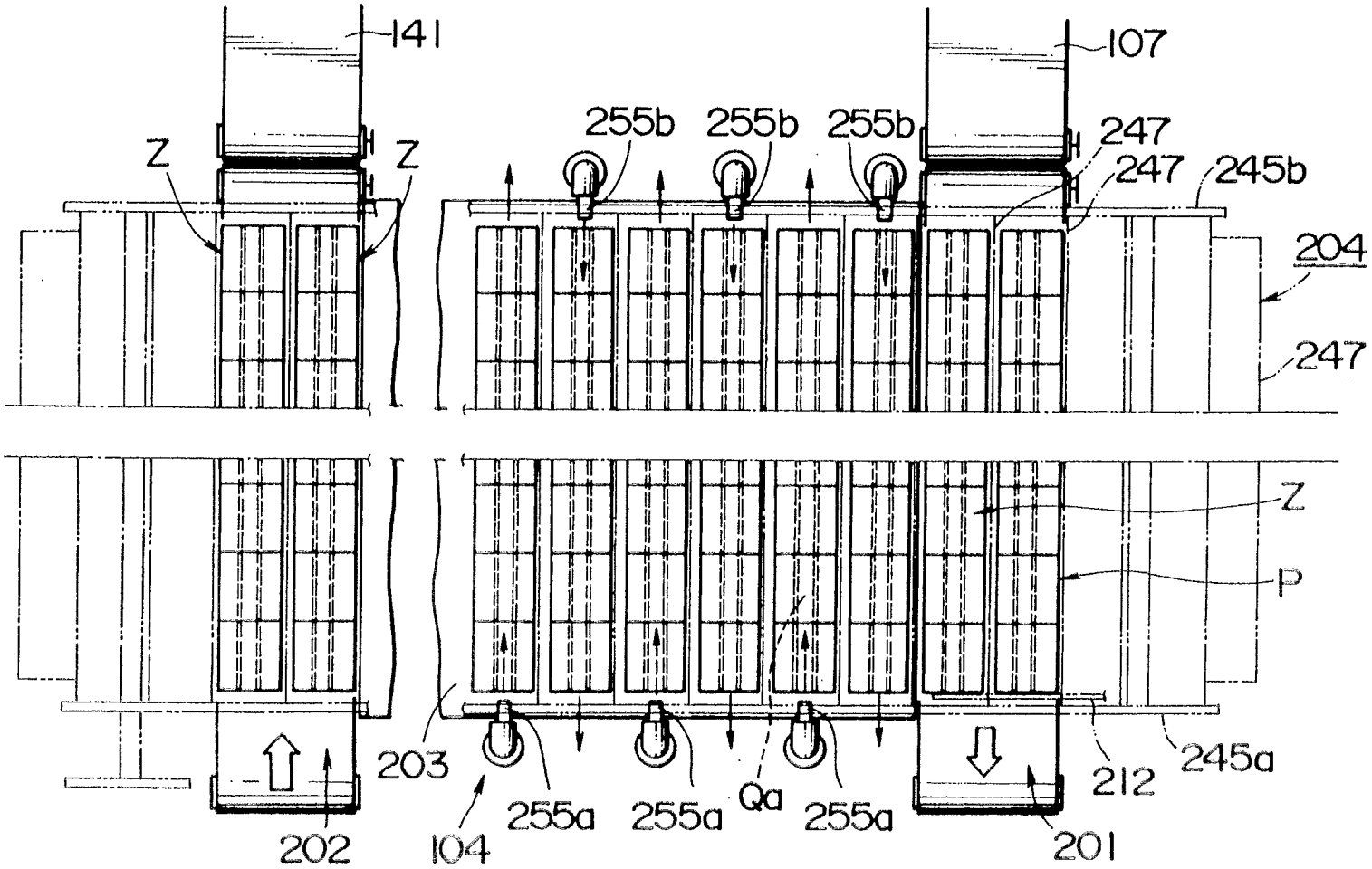
FIG. 10 is a partial plan view of FIG. 8.

Another emdodiment of the drying zone 104 is illustrated in FIGS. 8–12. Designated as 210 is a frame having a rectangular parallelopiped structure. Disposed in opposite longitudinal end portions of the frame 210 are a pair of laterally extending feed conveyer 201 and discharge conveyer 202, respectively, between which a flat table 203 extends. As shown in FIG. 10, the feed and discharge conveyers 201 and 202 and the table 203 have lateral length sufficient to support the array Z of the wound web-bearing cores P thereon with the axis of the array Z being laterally oriented.

Means 204 is provided for displacing the arrays Z of the wound web-bearing cores P on the table 203 from the feed side to the discharge side while maintaining the arrayed state. As shown in FIG. 10, the displacing means 204 includes a pair of laterally spaced apart endless chains 245*a* and 245*b* each supported between a pair of sprockets, and a plurality of parallel, spaced apart operating plates 247 each laterally extending between and fixed to the chains 245*a* and 245*b* for movement therewith. Each adjacent two operating plates 247 is spaced apart by a distance so that the array Z of the wound web-bearing cores P may be inserted therebetween and displaced on the table 203 therewith. Designated as 241 is driving means including a motor 242 and an indexing member 243 for rotating the sprockets such that the operating plates 247 oriented downward are moved in the direction from the feed side to the discharge side (right to left in FIG. 8).

Hot air injecting means 205 is provided for forming streams of hot air flowing laterally from both sides of the table 203 such that the hot air can pass through the center holes Q*a* of the arrays Z of the wound web-bearing cores P during the passage thereof on the table 203, thereby to dry the inner wet regions of the wound webs.

Figure 8:
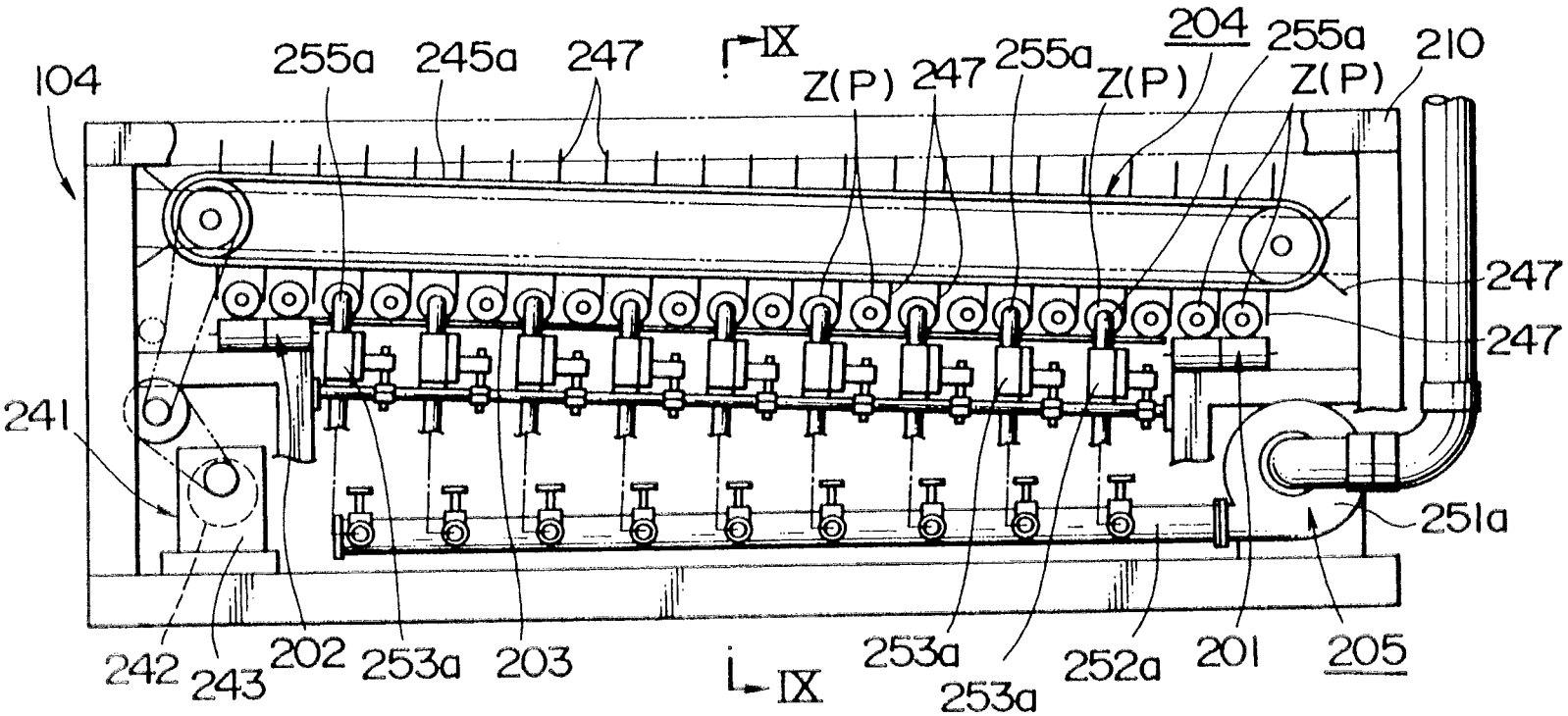
FIG. 8 is an elevational view diagrammatically showing another embodiment of drying device of the apparatus of FIG. 1.
Figure 9:
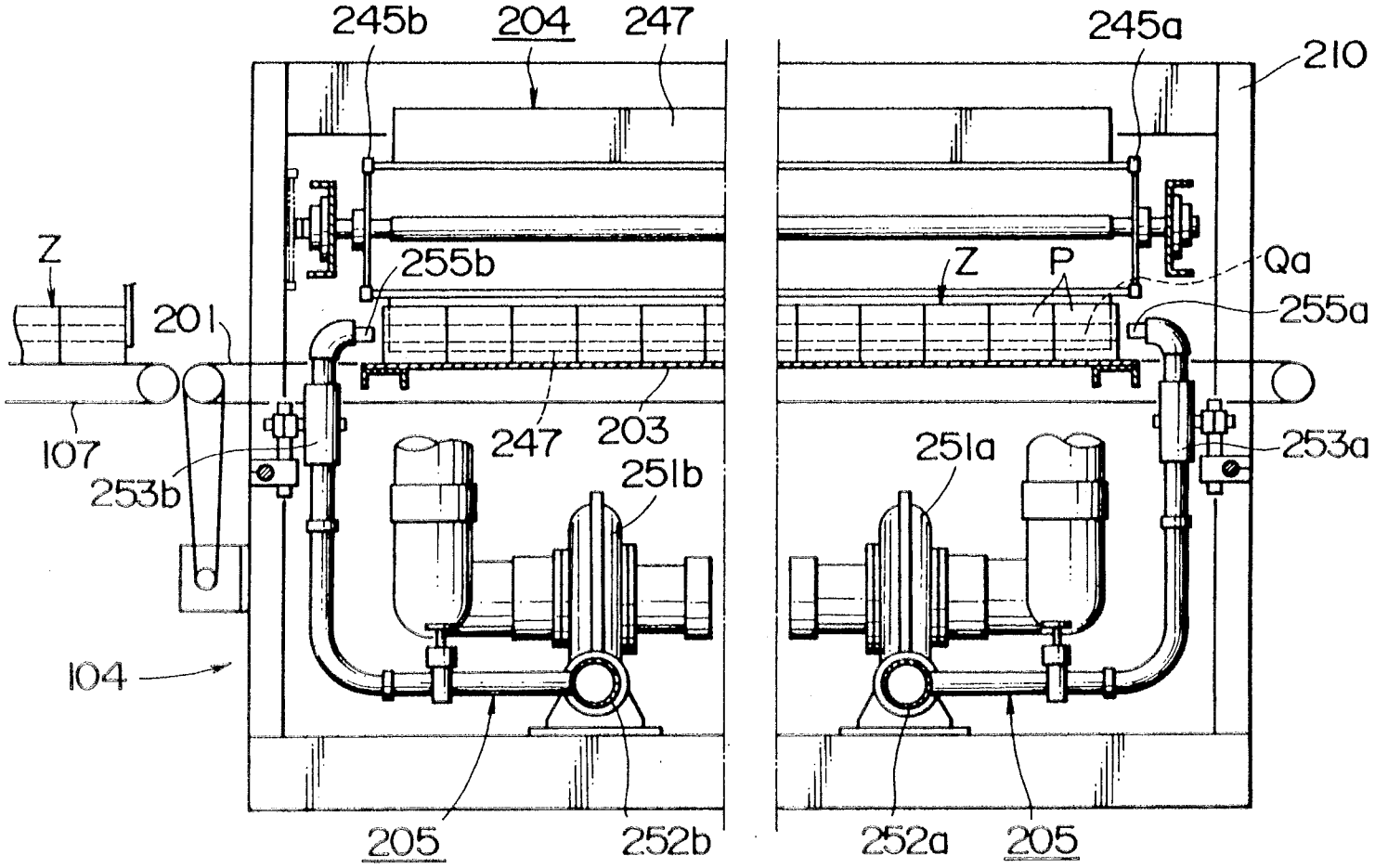
FIG. 9 is a partial, cross-sectional view taken on theline IX—IX in FIG. 8.

More particularly, as shown in FIG. 10, the feed conveyer 201 is connected downstream of the conveyer 107 leading from the collecting zone 103. Two parallel arrays Z of the wound web-bearing cores P are successively conveyed from the collecting zone by the conveyer 107 and are transferred on the conveyer 201 and simultaneously, as shown in FIG. 8, the two arrays Z are each inserted between adjacent two operating plates 247. Designated as 212 in FIG. 10 is a stopper plate for preventing the further movement of the arrayed, wound web-bearing cores P and for maintaining them in the predetermined position on the feed conveyer 201.

Figure 11:
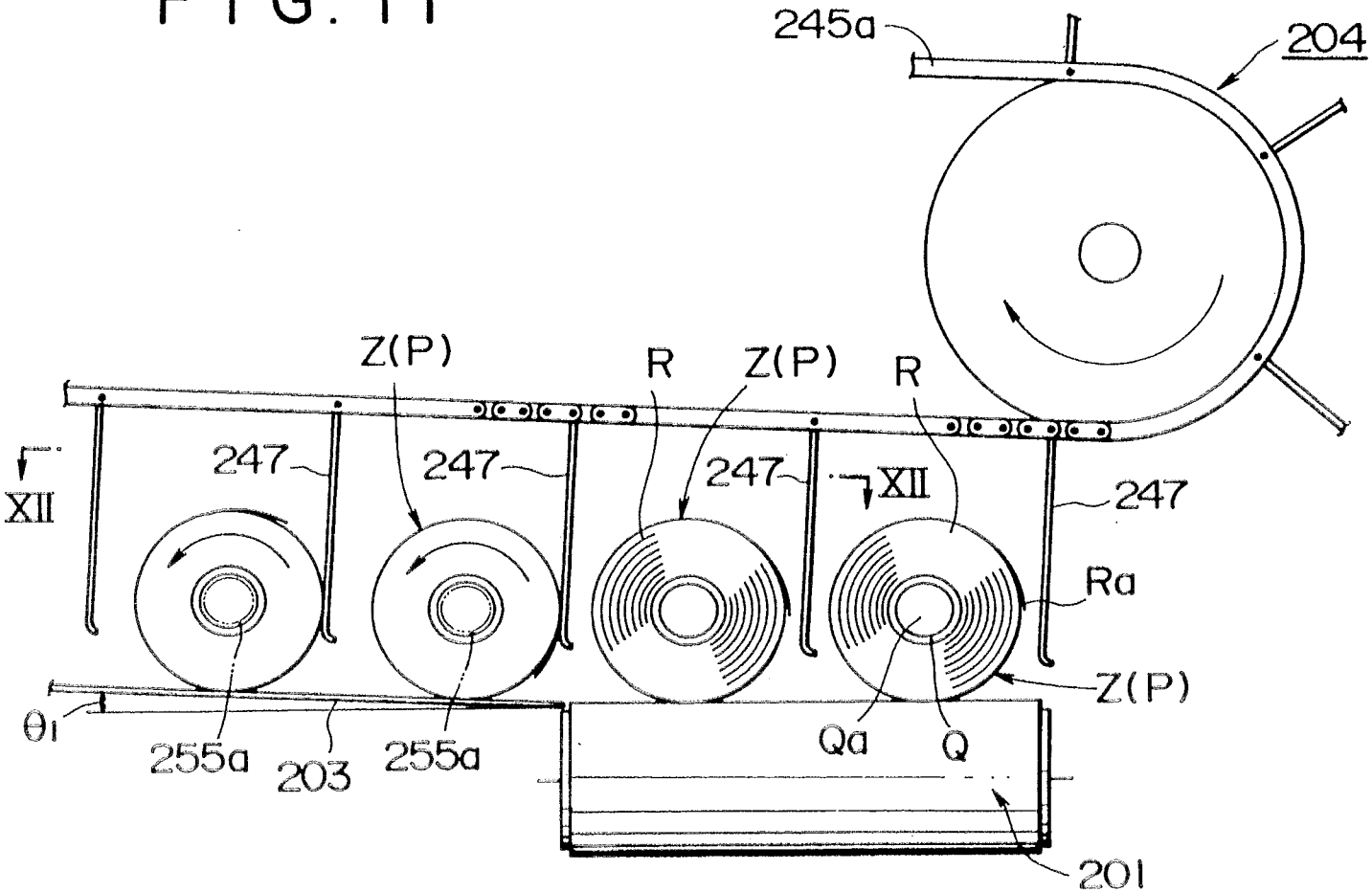
FIG. 11 is a fragmentary, enlarged view of FIG. 8.

The table 203 as illustrated has such a longitudinal length as to support 18 arrays of 16 wound web-bearing cores P. As seen from FIG. 8, the feed conveyer 201 is located at a level lower than that of the discharge conveyer 202 so that the table 203 is inclined upward by an angle $\Theta_1$, as shown in FIG. 11, for example 1–3 degrees, from the feed side to the discharge side. As a result of the inclined position of the table 203, each of the wound web-bearing cores P disposed between two adjacent leading and trailing operating plates 247 is maintained in contact with the trailing one, as shown in FIG. 11, so that notwithstanding the fact that the space between two adjacent operating plates is considerably greater than the diameter of the wound web, the wound web-bearing cores P on the table 203 are always coaxially aligned, especially when the chains 345*a* and 345*b* stop rotating.

The discharge conveyer 202 is disposed adjacent to the end of the table 203 to receive two arrays Z of the dried, wound web-bearing cores P from the table 203. These arrays Z are then conveyed on the coveyet 202 and transferred to the conveyer 141.

The displacing means 204 is preferably operated intermittently so that the operating plates 247 move stepwisely by a predetermined distance per one step. In the illustrated embodiment, the displacing means 204 is operated to move each array Z of the wound web-bearing cores P by a distance equal to the twice the distance between the two adjacent operating plates 247 per one step. The distance between the two adjacent operating plates 247 is greater than the outer diameter of the wound web and is, for example, 150–155 mm when the diameter of the wound web is 120 mm. The endless chains 245*a* and 245*b* extend in parallel with the table 203 so that the operating plates 247 also moves in the direction parallel with the table 203. The operating plates 247 may be substituted by laterally extending rods, if desired. The arrays Z of the wound web-bearing cores P displace while rolling on the table 203 from the feed side to the discharge side as the operating plates 247 displace.

The hor air injection means 205 preferably includes a plurality of equally spaced apart nozzles 255*a* and 255*b* arranged on both sides of the table 203 along the longitudinal direction of the table 203 and oriented so as to inject hot air therethrough in the lateral direction. In the illustrated embodiment, the injection means 205 includes a pair of fans 251*a* and 251*b* located on the feed side and discharge side, respectively, and connected to ducts 252*a* and 252*b*, respectively. Each of the ducts 252*a* and 252*b* is branched and connected to the nozzles 255*a* and 255*b*. Heaters 253*a* and 253*b* are mounted to respective nozzles 255*a* and 255*b*, so that the air introduced by the fans 251*a* and 251*b* is heated by the heaters 253*a* and 253*b* and injected from respective nozzles 255*a* and 255*b*. The nozzles 255*a* and 255*b* are located at positions where arrays Z of the wound web-bearing cores P rested on the table 203 and engaged by stopped operating plates 247 are coaxially aligned with respective axes of the nozzles, so that the hot air injected through the nozzles 255*a* and 255*b* can pass through coaxially aligned central holes Q*a* of respective arrays Z of the wound web-bearing cores P to accelerate the drying of the wound webs R. The hot air may be continuously injected through the nozzles 255*a* and 255*b* throughout the process. If desired, the injection of the hot air may be intermittently performed in synchronism with the operation of the displacing means 204, i.e. only during the stop of the arrays Z on the table 203.

The drying device 104 shown in FIGS. 8–12 operates as follows. As shown in FIG. 10, two arrays Z of the wound web-bearing cores P are transferred from the conveyor 107 to the conveyer 201 and are stopped in position upon engagement of their leading ends with the stopper plate 212, where each array Z is received between adjacent two operating plates 247. It is recommendable to place the arrays Z on the conveyer 201 such that, as shown in FIG. 11, the winding direction of the web of each wound web-bearing core P is opposite to the rolling direction thereof when displaced on the table 203 by the operating plates 247, since otherwise the wound web would be unwound during the movement on the table 203.

Figure 12:
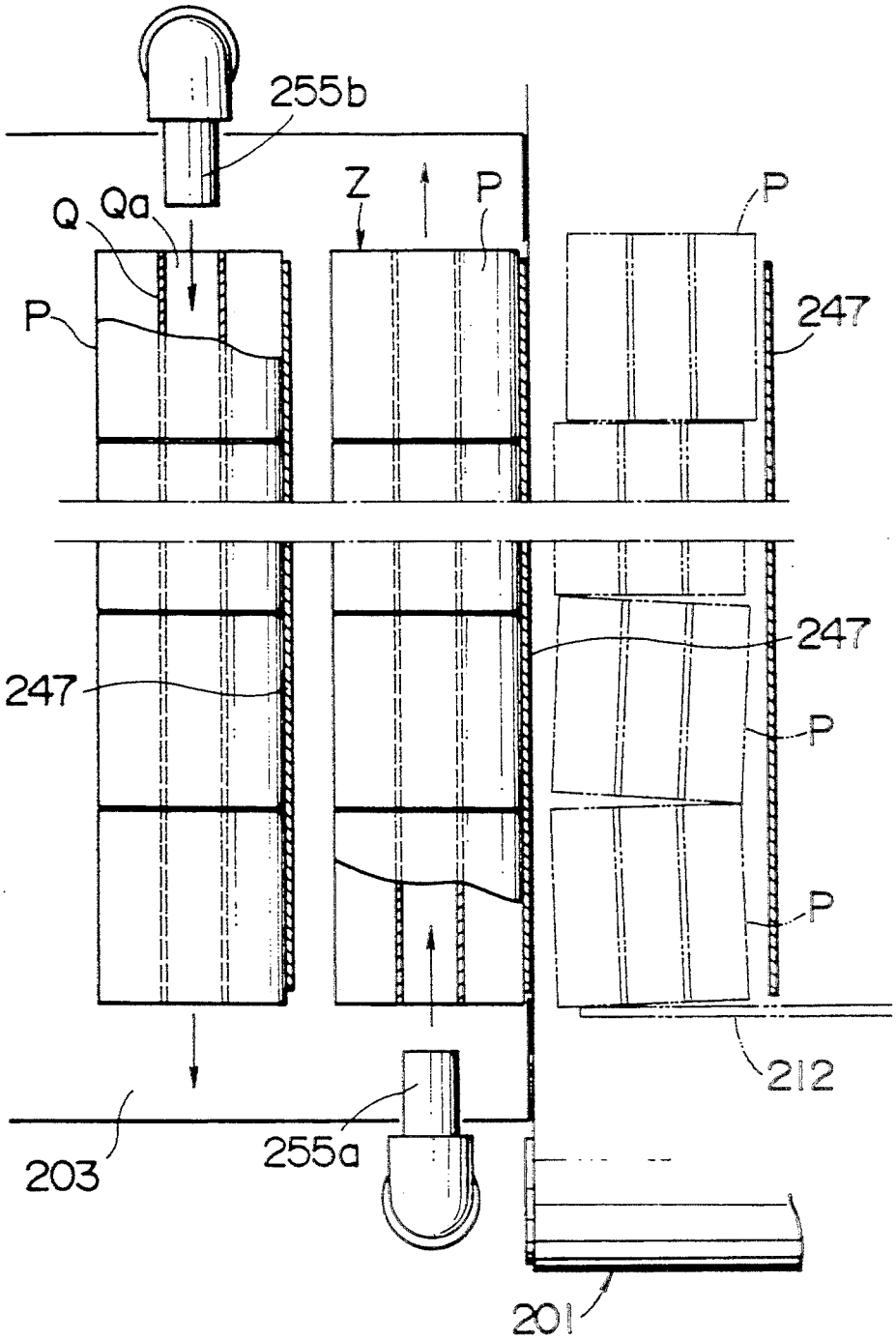
FIG. 12 is a cross-sectional view taken along the line XII—XII in FIG. 11.

Then, the displacing means 204 is operated to displace the operating plates 247 through a predetermined distance, i.e. a distance equal to twice the distance between two adjacent displacing plates 247 in the illustrated case, so that the two arrays Z are transferred to the table 203. Though, as shown in FIG. 12, the wound web-bearing cores P rested on the horizontal conveyer 201 have not been exactly coaxially aligned with each other, they are aligned when displaced to the inclined table 203.

The arrays Z of the wound web-bearing cores P are then stepwisely displaced on the table 203 by the above-mentioned, predetermined length per each step. In the stopped positions, the injected hot air from respective nozzles 255*a* and 255*b* passes through the central holes Q*a* respective arrays Z for the drying of the wound webs. The arrays Z of the wound web-bearing cores P thus dried are transferred from the table 203 to the discharge conveyer 202 and then to the conveyer 141. The feed conveyer 201, the displacing means 204 and the discharge conveyer 202 are synchronously intermittently operated so that the drying of the inner portion of the wound web is continously performed.

Figure 13:
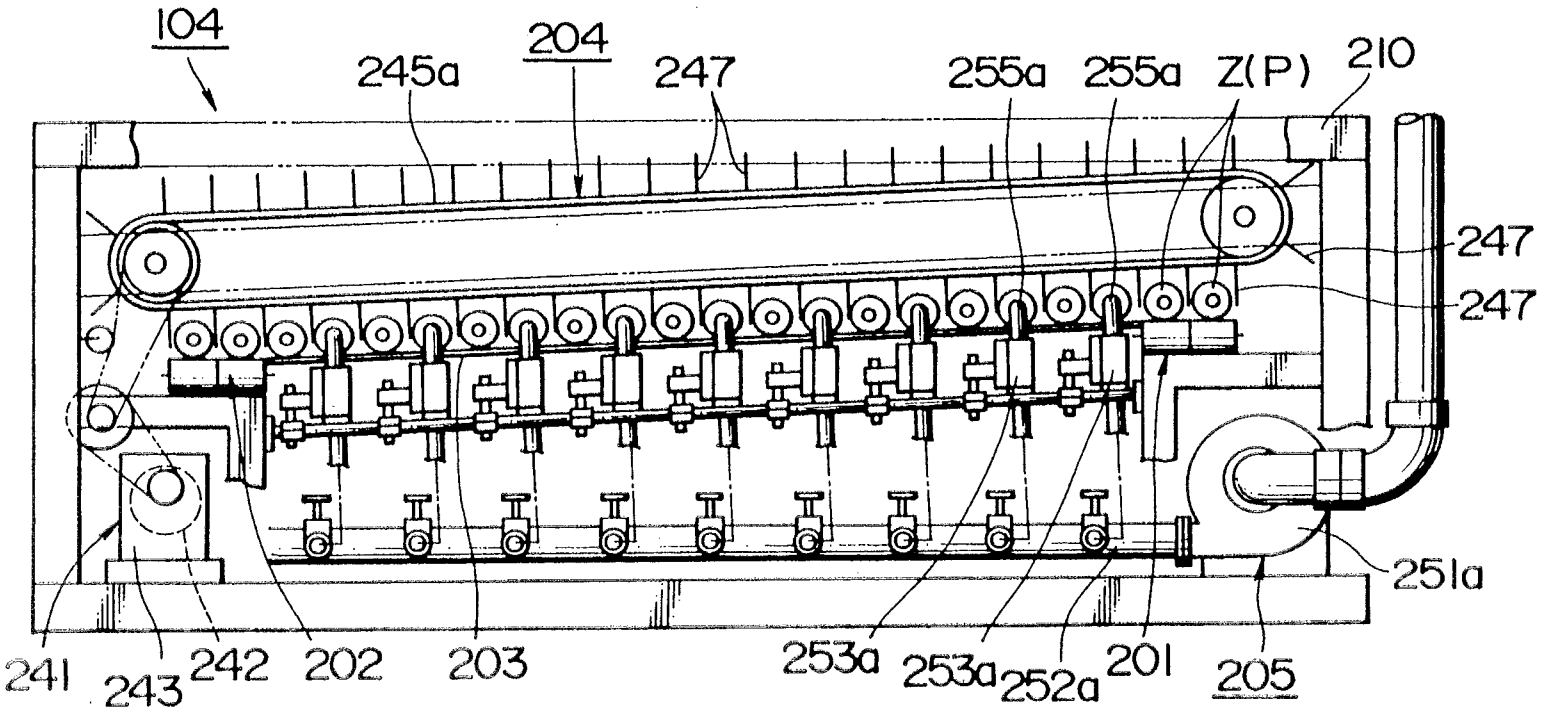
FIG. 13 is an elevational view, similar to FIG. 8, diagrammatically showing a further embodiment of drying device of the apparatus of FIG. 1.
Figure 14:
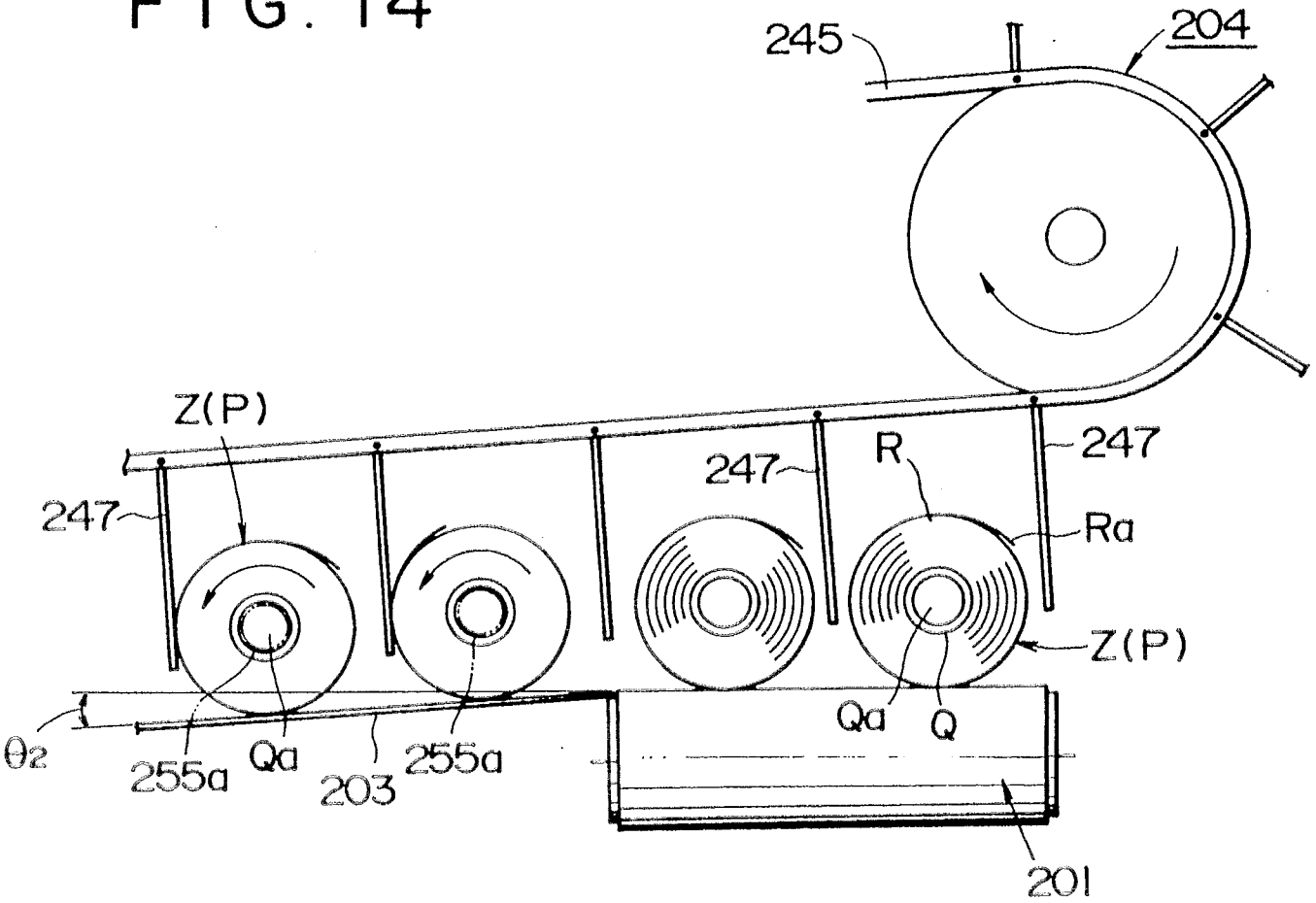
FIG. 14 is a fragmentary, enlarged view of FIG. 13, similar to FIG. 11.

FIGS. 13 and 14 depict an alternate embodiment of the drying apparatus 104. In FIGS. 13 and 14 the same reference numerals as in FIGS. 8–12 designate similar component parts. The embodiment of FIGS. 13 and 14 differs from the above embodiment in that the table 203 is inclined downward by an angle $\Theta_2$ of, for example 2–5 degrees, from the feed side to the discharge side so that the array Z of the wound web-bearing cores P disposed between adjacent two, leading and trailing operating plates 247 is maintained in contact with the leading operating plate, as shown in FIG. 14.

In this embodiment, since the table 203 is inclined downward in the displacing direction, the arrayed web-bearing cores P can roll thereon by gravity as the operating plates 247 move so that there is almost no likelihood of wearing or injuring of the outer surfaces of the wound webs by sliding contact with the table 203. In particular, there is no fear of the separation or unwinding of the bonded outermost layer of the wound web during the movement on the table 203.

The thus dried web-bearing cores P are then conveyed by the conveyer 141 to the separation zone 105 to separate the wound webs R from the cores Q. FIGS. 15–24 illustrate a preferred embodiment of the separation zone 105.

Figure 15:
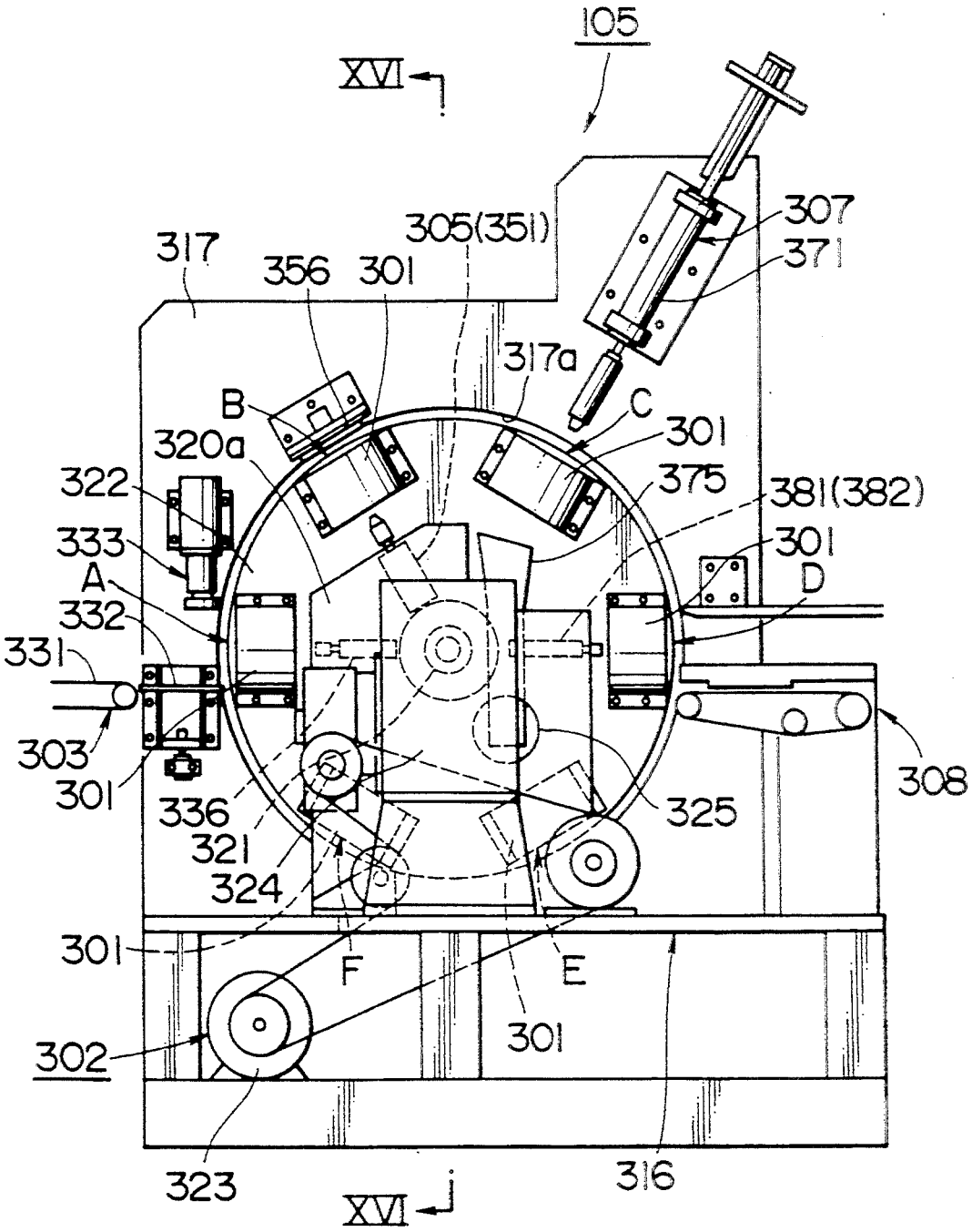
FIG. 15 is an elevational view showing a separation device for separating cylindrical cores from wound webs in the apparatus of FIG. 1.
Figure 16:
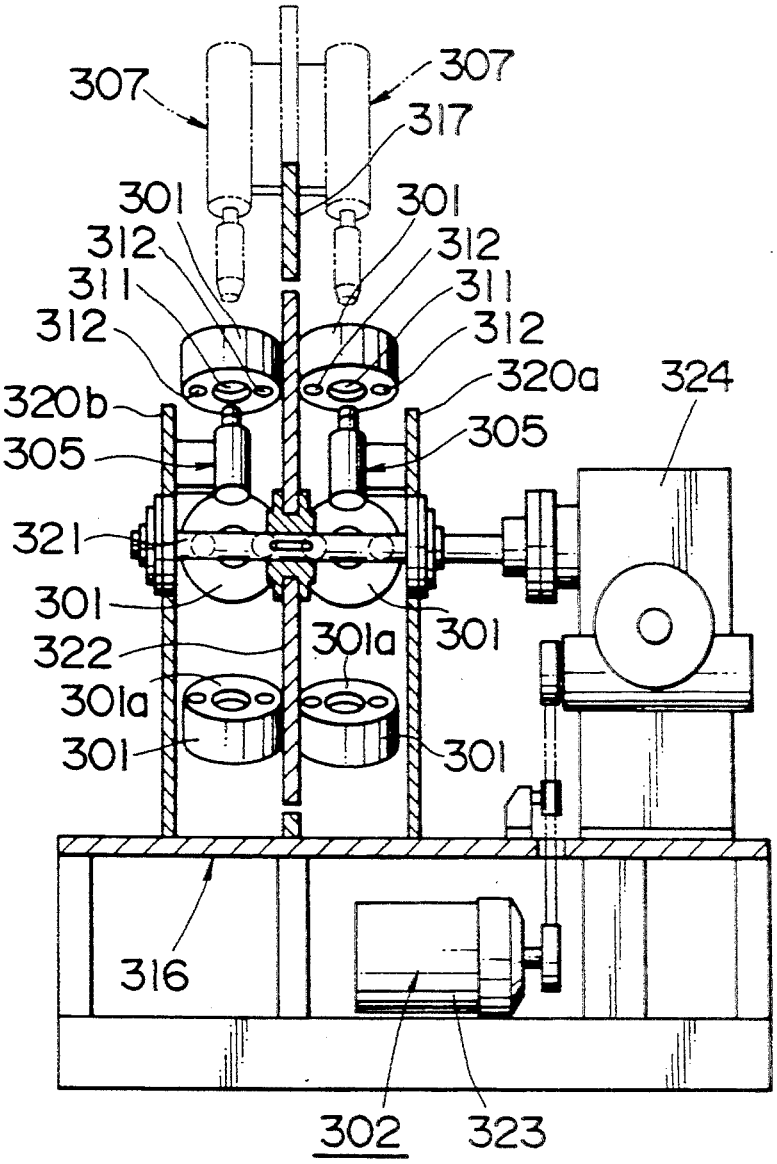
FIG. 16 is a sectional view taken along the line XVI—XVI in FIG. 15.

Referring to FIGS. 15 and 16, designated generally as 316 is a frame having a pair of spaced apart vertical side plates 320*a* and 320*b* and a center plate 317 interposed therebetween and having a large opening 317*a*. A disc 322 is rotatably supported between the side plates 320*a* and 320*b* about a central, horizontal shaft 321 and is disposed on the same plane as the center plate 317 in the opening 317*a* thereof.

Six, angularly equally spaced apart cylindrical holders 301 are fixedly secured on a periphery of each side of the disc 322 with the axis of each of the cylindrical holders 301 being oriented in the radial direction of the disc 322. Each of the cylindrical holders 301 has an inside diameter greater than the outer diameter of the wound web R and has an axial length substantially equal to or slightly shorter than the axial length of the wound web-bearing core P. Each holder 301 is opened at the outward end thereof and closed at the inward end thereof with a bottom plate 301*a* for supporting the wound web-bearing core P thereon. The bottom plate 301*a* is provided with a central opening 311 having a diameter greater than than the outer diameter of the core Q and at least two holes 312 arranged symmetrically with respect to the center axis of the holder 301.

Figure 17:
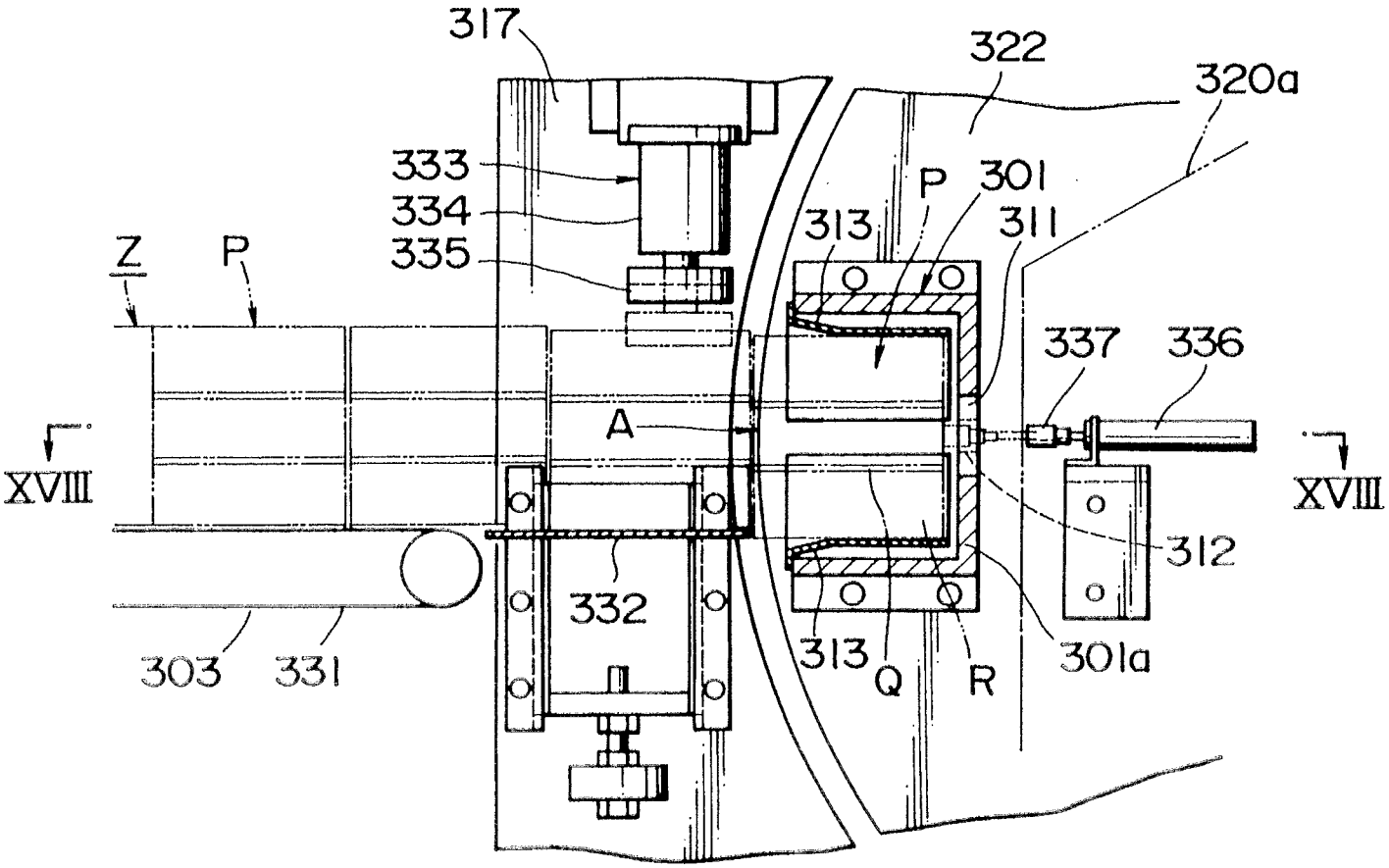
FIG. 17 is a partial, enlarged, cross-sectional view diagrammatically showing a feed station of FIG. 15.

As shown in FIG. 17, a guide member 313 is provided in each of the holders 301 for receiving the wound web-bearing core P therein. The guide member 313 is composed of a pair of semicylindrical plates defining therebetween a substantially cylindrical space into which the wound web-bearing core P is to be fitted. The positions of the plates constituting the guide member 313 are radially adjustable so that the diameter of the cylindrical space is adjustable to a desired value depending on the diameter of the wound web to be held therein.

As shown in FIG. 15, drive means 302 is provided for stepwisely rotating the disc 322 through 60 degrees per each step, so that each of the holders 301 is positionable successively at first to sixth positions A–F by rotation of the disc 322. The holders 301 located at the first and fourth positions A and D are oriented substantially horizontally while the holders 301 located at the second and third positions B and C are obliquely upwardly oriented. The drive means 302 includes a motor 323 and an indexing device 324 operatively connected to the shaft 321 of the disc 322.

A feed device 303 is secured to the frame 316 at a location adjacent to the first position A for feeding each of the dried wound web-bearing cores P to the holder 301 located at the first position. At a location adjacent to the second position B, projecting means 305 is supported on the frame 316 for projecting, radially outwardly with respect to the disc 322, an end portion of the core Q from the top end of the dried wound web R held by the holder 301 located in the second position B. At a location adjacent to the third position C, a pushing device 307 is supported on the frame 316 for pushing, radially inwardly with respect to the disc 322, the core Q of the dried wound web-bearing core P held by the holder located in third position C so as to separate the core Q from the dried wound web R and to discharged the core Q from the holder 301. At a location adjacent to the fourth positon D, pushing means 308 is supported on the frame 316 for pushing the dried wound web R held in the holder 301 located in said the position out of the holder 301. In the illustrated embodiment, the holders 301 are secured on both sides of the disc 322, as shown in FIG. 16, with the above respective means 303, 305, 307 and 308 being also provided to act on both sides of the disc 322. Since the structure and operation of the separation means 105 on both sides of the disc 322 are the same, the following description will be limited only to one side thereof.

Figure 18:
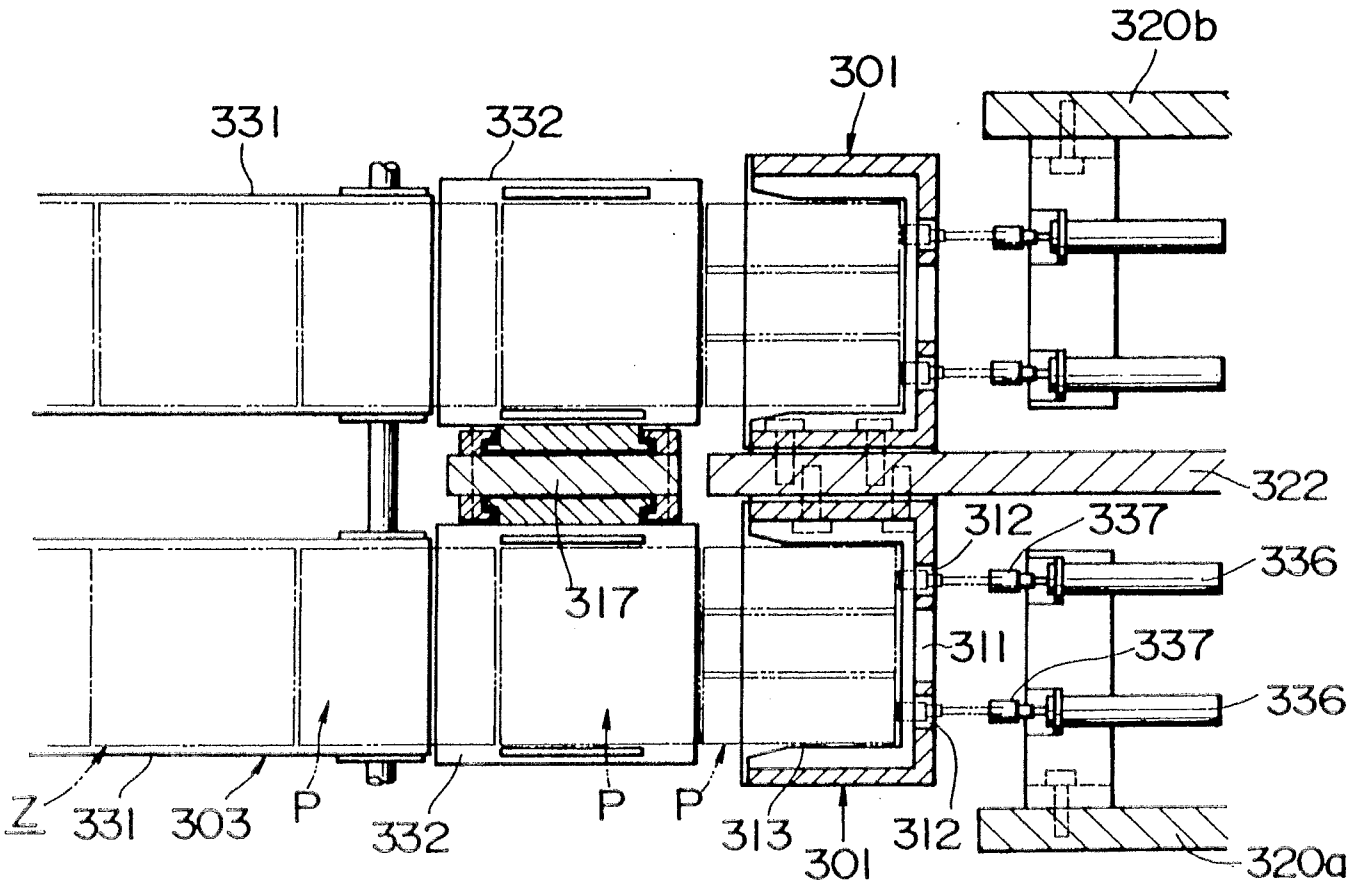
FIG. 18 is a cross-sectional view taken along the line XVIII—XVIII in FIG. 17.

As shown in FIGS. 17 and 18, the feed device 303 includes a belt conveyer 331 disposed downstream of the conveyer 141 (FIG. 10) for horizontally displacing the array Z of the dried wound web-bearing cores P, obtained in the previous drying zone 104, along the axis thereof to the holder 301 located in the first position A, and stopper means 333 operable to stop the movement of the dried wound web-bearing cores P during the rotation of the disc 322, i.e. when there is no holder 301 located at the first position A.

Disposed in the downstream end of the conveyer 331 is a table 332 for supporting the wound web-bearing core P thereon. The stopper means 333 is disposed above the table 332 and has an engaging plate 335 which is connected to the tip end of a rod of a cylinder 334 so that the engaging plate 335 is moved, by the operation of the cylinder 334, between a lower, engaging position as shown by the two dotted line in FIG. 17, where the engaging plate 335 is in pressure engagement with an outer surface of wound web-bearing core P on the table 332, and an upper, disengaging position as shown by the solid line in FIG. 17, where the engaging plate 335 is kept disengaged from the wound web-bearing core P.

Thus, when the holder 301 is located at the first position A and when the engaging plate 335 is in the upper position, the arrayed, wound web-bearing cores P are moved by the operation of the conveyer 331 so that the wound web-bearing core P which is located at the leading end of the array Z and which is placed on the table 332 is fed to and received by the holder 301. After the leading end wound web-bearing core P has been inserted into the holder 301 to a predetermined depth, the cylinder 333 is operated to lower the engaging plate 335 to its lower position so that the engaging plate 335 engages with the wound web-bearing core P on the table 332, thereby to stop the movement of the array Z.

Means is provided adjacent to the first position A to control the insertion degree of the wound web-bearing core P into the holder 301. As shown in FIG. 18, the control means is composed of a pair of cylinders 336 operated to displace the tip end 337 of each of the cylinder rods thereof between an extended position as shown by the solid line and a retracted position as shown by the two dotted line. In its extended position, the tip end 337 extends through the hole 312 of the bottom plate 301*a* into the holder 301 to engage with the top surface of the wound web-bearing core P which is being fed into the holder 301. In the retracted position, the holder 301 is not engaged by the rod of the cylinder 336 to permit the rotation of the disc 322.

The feed device 303 operates as follows. During the rotation of the disc 322, the engaging plate 335 of the stopper means 333 is in its lower position to stop the movement of the array Z of the wound web-bearing cores P while the tip end 337 of each of the cylinders 336 is in its retracted position. When the disc 322 is stopped to position one of the holders 301 at the first position A, the cylinder 336 are actuated to extend the tip ends 337 through the holes 312 of the bottom plate 301*a*. Then the cylinder 334 is operated to disengage the engaging plate 335 from the outer surface of the wound web, so that the array Z of the wound web-bearing cores P is displaced, Thus, the leading end, wound web-bearing core P is transferred from the table 332 to the holder 301 and stops moving when the end surface thereof is brought into abutting engagement with the tip ends 337. Then, the cylinder 334 is operated to stop the movement of the array Z by engagement of the engaging plate 335 with the wound web-bearing core P placed on the table 332. The cylinders 336 are subsequently actuated to retract the tip ends 337.

As a consequence, there is formed a space between the end surface of the wound web-bearing core P received in the holder 301 and the bottom plate 301*a*. Then, the disc 322 is rotated by an angle of 60 degrees to displace the holder 301 carrying the wound web-bearing core P from the first position A to the second position B with the simulataneous displacement of the empty holder 301 from the sixth position F to the first position A. In this case, since the wound web-bearing core P received in the holder 301 is in abutting engagement with the adjacent, fixed, wound web-bearing core P on the table 332, the wound web-bearing core P in the holder 301 receives a force in the radially outward direction with respect to the disc 322 (rightward in FIG. 17). Since, as mentioned above, there is formed a space in the bottom of the holder 301, the wound web-bearing core P in the holder can move toward the bottom of the holder 301, so that the disc 322 can be smoothly rotated without interference in the contact portion of the adjacent two, wound web-bearing cores P.

Figure 19:
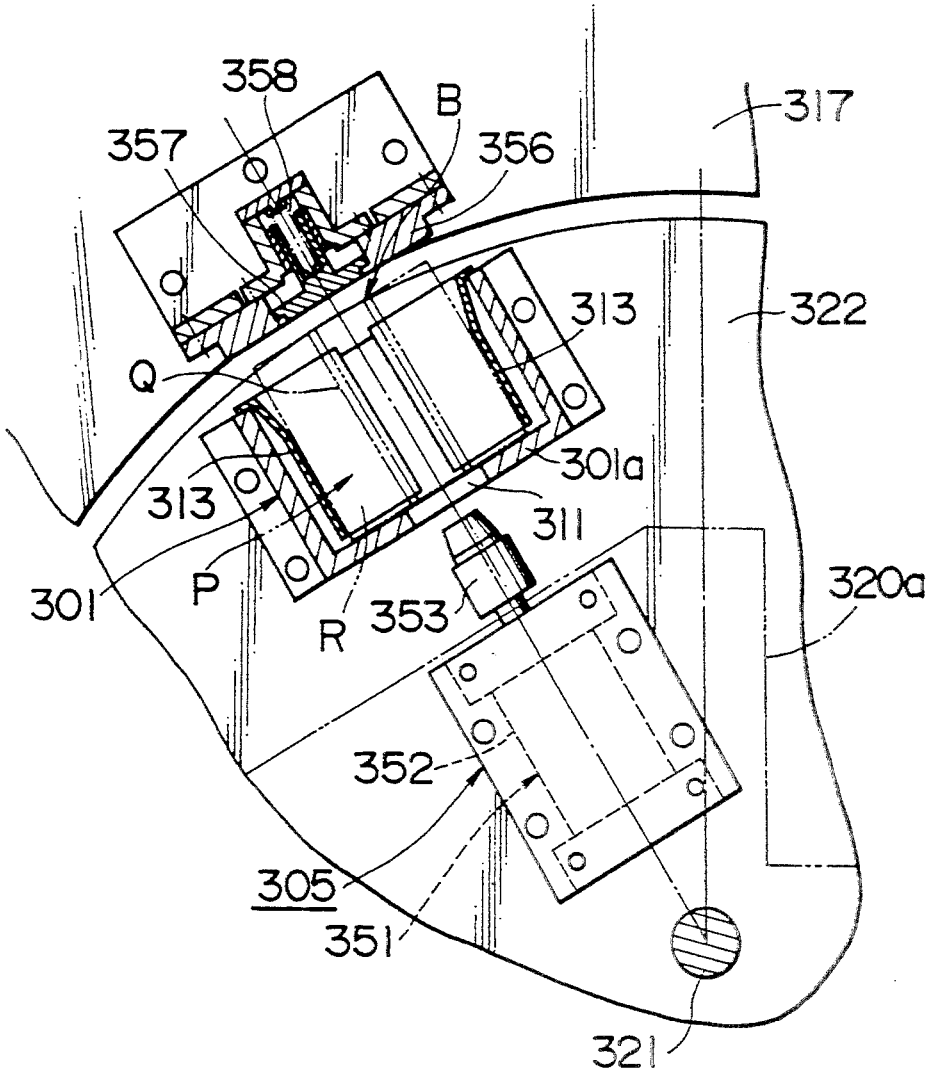
FIG. 19 is a partial, enlarged, cross-sctional view diagrammatically showing a core projection station of FIG. 15.
Figure 20:
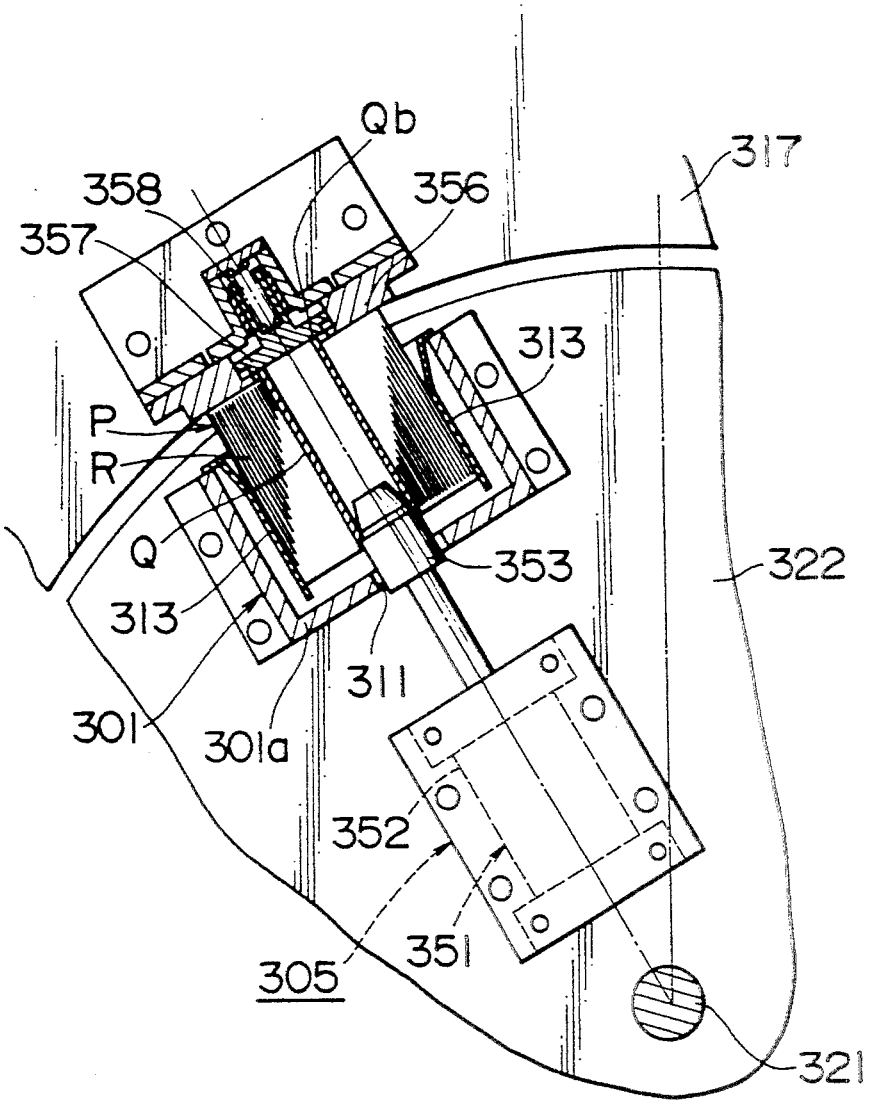
FIG. 20 is a sectional view showing the operation of the projection station of FIG. 19.

FIGS. 19 and 20 illustrate the projection means 305 provided ajacent to the second position B. The projection means 305 is optional and may be omitted as desired. The projection means 305 includes a pushing member 351 secured to the vertical plate 320*a* of the frame 316 for pushing the core Q of the wound web-bearing core P in the holder 301 located at the second position B, and an annular support plate member 356 secured to the center plate 317 of the frame 316 and cooperable with the pushing member 351.

The pushing member 351 is composed of a cylinder 352 having a rod whose head 353 has a diameter not greater than the diameter of the core Q and which is extended and retracted in the radial direction of the disc 322 so that, in the extended state, the head 353 extends through the center opening 311 of the bottom plate 301*a* of the holder 301 for abutting engagement with the core Q of the wound web-bearing core P. The annular support plate member 356 is disposed for engagement with the top surface of only the wound web R of the wound web-bearing core P and has a central opening which is substantially concentrical with the opening 311 of the bottom plate 301*a* of the holder 301 located in the second position B and which has such a diameter as to permit passage of the core Q therethrough. Disposed in the central opening of the annular support plate member 356 is an engaging plate 357 supported and normally urged radially inwardly with respect to the disc 322 by a coil spring 358 received by a support member secured to the plate 317.

The thus constructed projection means 305 operates as follows. When the holder 301 holding the wound web-bearing core P therein is stopped at the second position B, the pushing member 351 operates to extend the head 353 through the opening 311 of the holder 301. When the pushing member 351 is further operated, the head 353 is abutted by the core Q and pushes the core Q. Thus, the wound web-bearing core P is moved radially outwardly with respect to the disc 322 and is brought into engagement with the annular support plate 356. Upon further operation of the pushing member 351, the core Q only is pushed against the biassing force of the spring 358 with the wound web R surrounding the core Q being kept unmoved by the engagement by the support plate 356, as shown in FIG. 20. As a result, an end portion Q*b* of the core Q is slightly (for example 5 mm) protruded. Then, the push member 351 is operated to retract the head 353 to the original position. Thus, the wound web-bearing core P returns by gravity to the original position in the holder 301 with the end portion Q*b* of the core Q protruding from the top surface of the wound web R. Then, the holder 301 is displaced to the third position c.

The above projecting step is effective in smoothly separating the core Q from the wound web R in the subsequent step in which the core Q is pushed in the reverse direction. Namely, since the core Q has been once slightly moved in one direction, the core Q is more easily separated from the wound web R by the movement of the core Q in the other direction. In particular, when the core Q is slightly moved in one direction, the inner portion of the wound web R adjacent to the core Q is moved and protruded together with the core Q by friction. When the core Q is then pushed in the other direction out of the wound web R, the protruded portion of the wound web R is returned substantially in flush with the other portion thereof.

Figure 21:
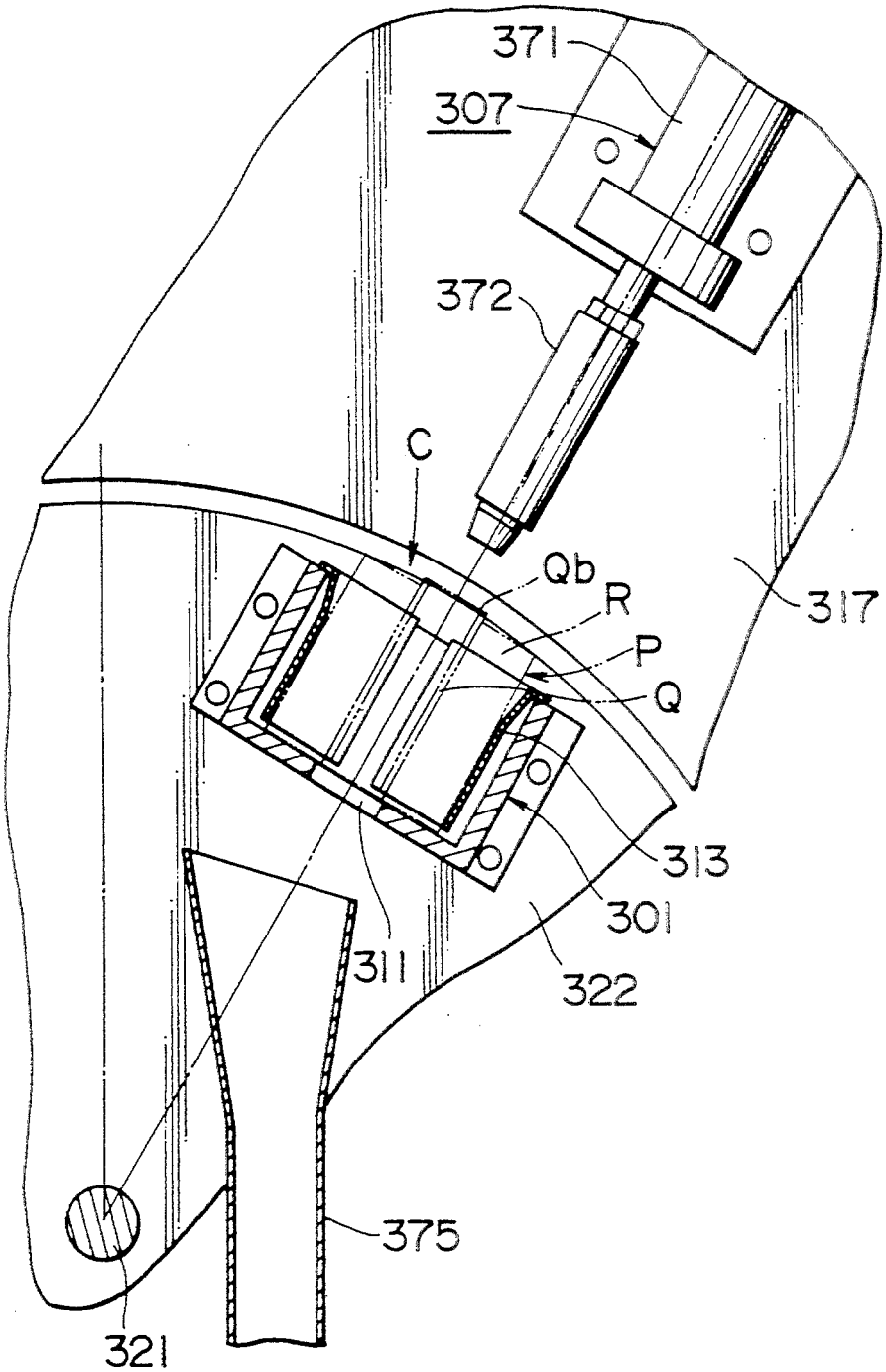
FIG. 21 is a partial, enlarged, cross-sectional view diagrammatically showing a separation station of FIG. 15.
Figure 22:
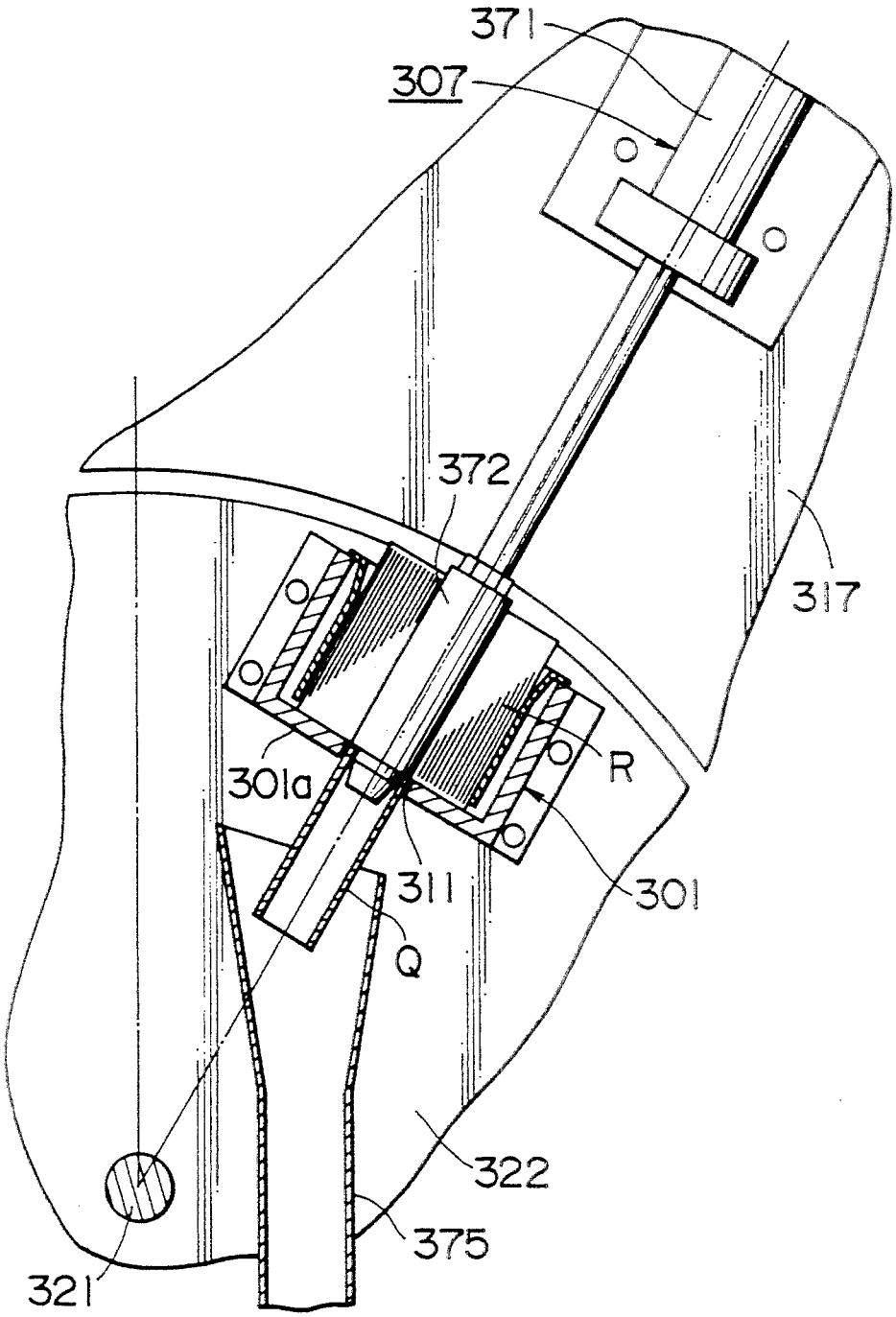
FIG. 22 is a sectional view showing the operation of the separation station of FIG. 21.

As shown in FIGS. 21 and 22 The pushing device 307 is secured to the central plate 317 of the frame 316 at a position adjacent to the third position C for removing the core Q from the round web-bearing core P held in the holder 301 located at the third position C. The pushing device 307 is composed of a cylinder 371 having a rod whose head 372 has a diameter smaller than the outer diameter of the core Q but is greater than the inside diameter of the core Q and which is oriented coaxially with the holder 301 in the third position C. The head 372 of the cylinder rod is extended and retracted by the operation of the cylinder 371 and is adapted to be in abutting engagement with only the core Q of the wound web-bearing core P when extended, to push the core Q out of the holder 301 with the wound web R remaining in the holder 301. Designated as 375 is a tubular guide member having one end which opens to the central opening 311 of the bottom plate 301 of the holder 301 located at the third position C, for rceeiving the core Q discharged from the holder 301 through the opening 311. The other end 325 of the tubular guide member 375 opens at the vertical plate 320*a* of the frame 316 (FIG. 15) for the recovery of the cores Q.

The pushing device 307 operates as follows. After the holder 301 holding the wound web-bearing core P therein has been displaced from the second position B to third position C, the cylinder 371 operates to extend the rod thereof so that the tip end of the rod is abutted by the slightly projected core Q. Upon further operation of the cylinder 371, the core Q only is pushed out of the holder 301 with the-wound web R surrounding the core Q being kept in the holder 301 as shown in FIG. 22. The thus separated core Q is received by the guide member 375 and collected for reuse. The cylinder rod is then retracted as shown in FIG. 21. The wound web R thus separated from the core Q is then transferred to the fourth position D and pushed out of the holder 301 by the pushing means 308.

Figure 23:
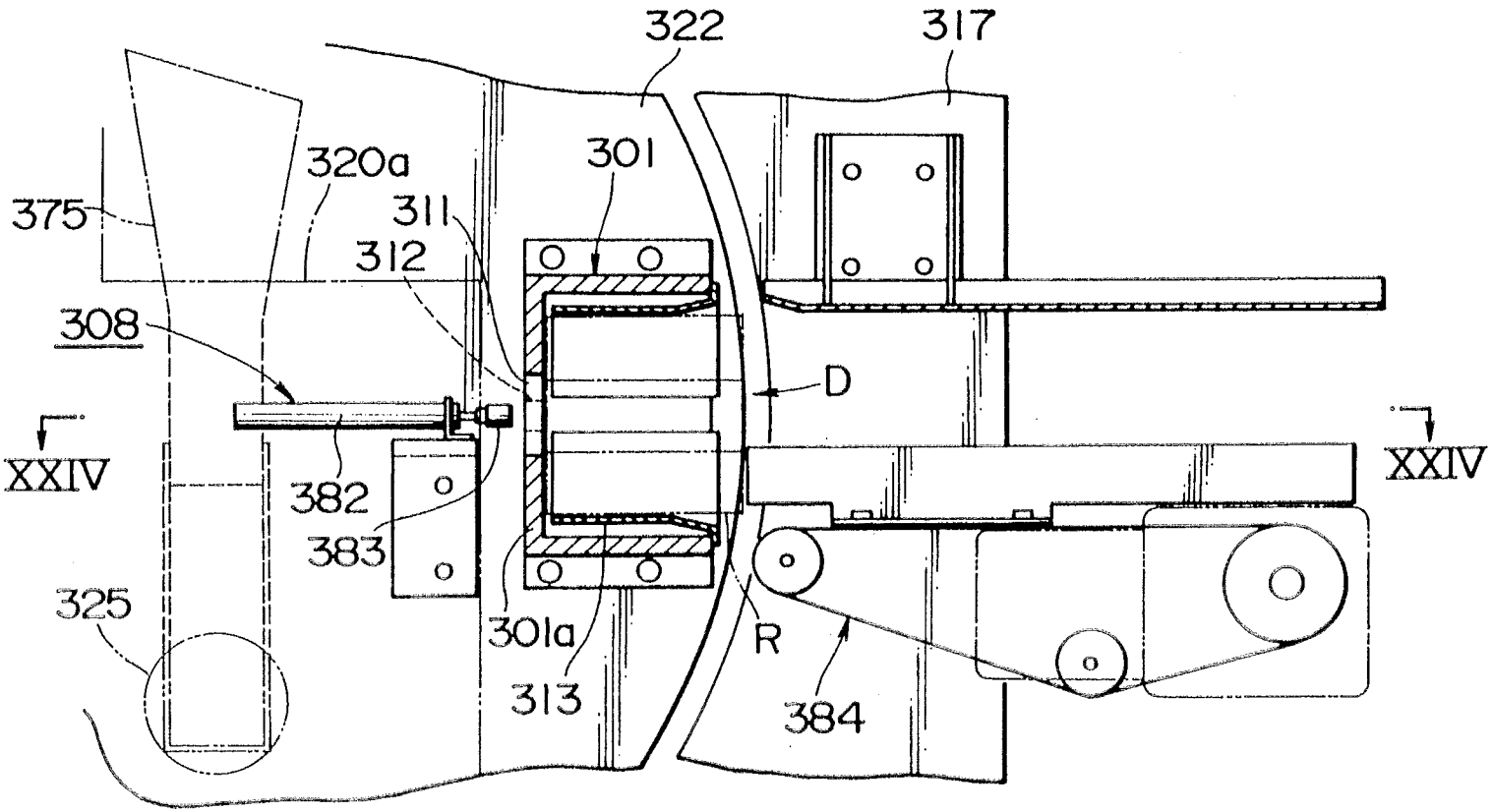
FIG. 23 is a partial, enlarged, cross-sectional view diagrammatically showing a delivery station of FIG. 15.
Figure 24:
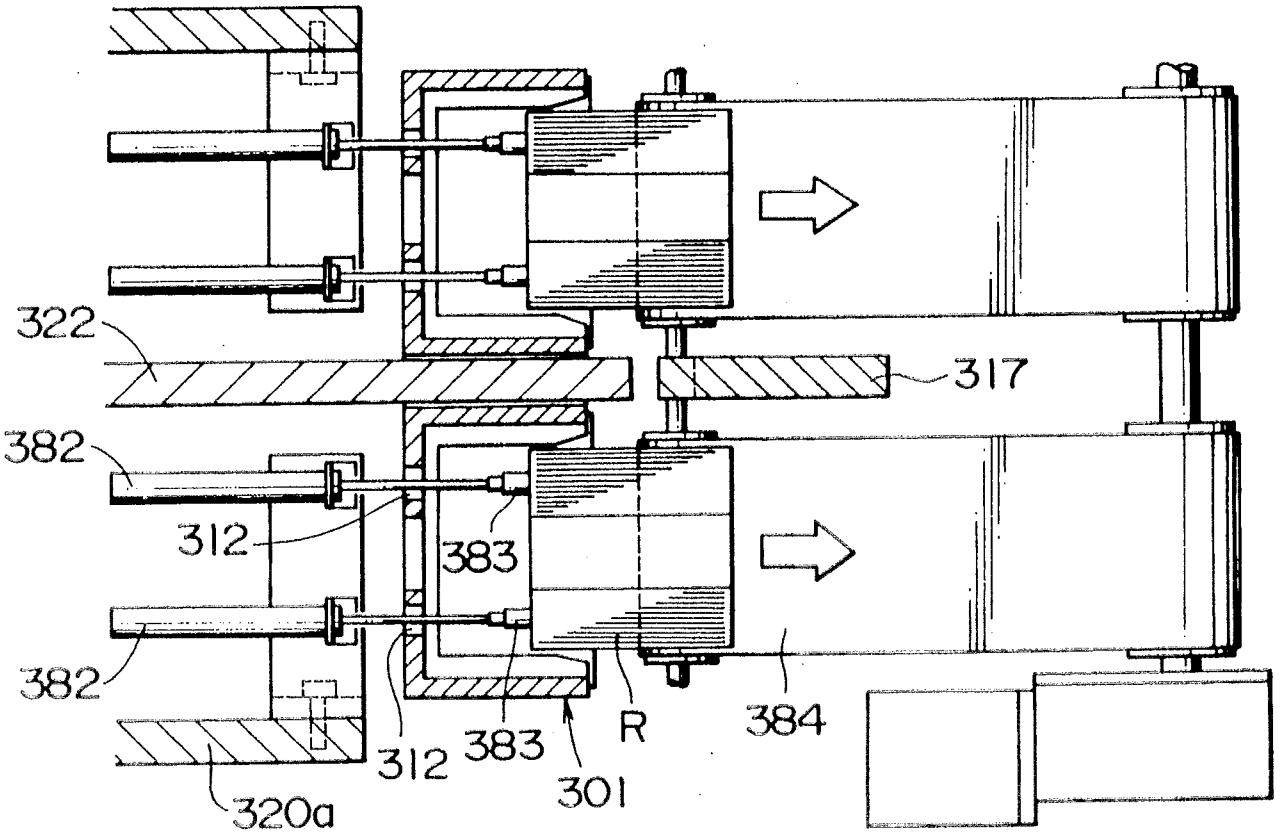
FIG. 24 is a sectional view taken along the line XXIV—XXIV in FIG. 23.

As shown in FIGS. 23 and 24, the pushing means 308 includes a pair of pistons 382 each having a piston rod whose head 383.has a diameter not greater than the diameter of the hole 312 of the bottom plate 301*a* and which is extended and retracted in the radial direction of the disc 322 so that, in the extended state, the head 383 extends through the hole 312 abutting engagement with the wound web R held in the holder 301. Disposed adjacent to the open end portion of the holder 301 located at the fourth position D is a conveyer 384 for receiving the wound web R which has been pushed out of the holder 301 by the head 383 of the piston rod.

The pushing means 308 operates as follows. After the holder 301 holding the wound web R therein has been displaced from the third position C to fourth position C, the cylinders 382 operate to extend the rods thereof so that the head 383 of each of the rods extends through the hole 312 and is abutted with the bottom of the wound web R. Upon further operation of the cylinders 382, the wound web R is pushed out of the holder 301 as shown in FIG. 24. The thus discharged web R is received on the conveyer 384 as shown in FIG. 21 and is transferred to the conveyer 151 (FIG. 1) leading to the packing device 106. The cylinder rods are then retracted to the original position as shown in FIG. 23. The holder 301 from which the wound web R has been removed is then successively displaced to the fifth and sixth positions E and F and is again located at the first position A for receiving the wound web-bearing core P.

FIG. 25 depicts another embodiment of the present invention in which a powder adhesive is used in place of the liquid for binding the inner region of the wound web R. The powder adhesive is fusible when heated. Thus, the powder adhesive applied in an inner region of the would web may be fused to bind the inner region when the web is heated, for example, with hot air using, for example, the previously described drying device shown in FIGS. 8–14.

Figure 26:
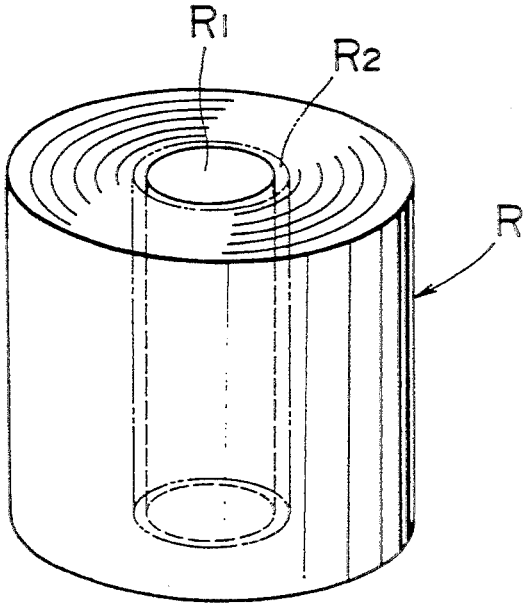
FIG. 26 is a perspective view shcematically showing a "coreless" toilet paper roll produced by the method according to the present invention.

As shown in FIG. 26, a continuous raw material paper web $T_1$ is unwound from a roll S and longitudinally severed in a slitting device 111 into a plurality (for example, 16 strips) of webs $T_2$. The slit webs $T_2$ are wound in a winding section 112 around respective cylindrical cores supported on a common shaft V in the same manner as that described with reference to FIG. 2.

Means such as a dispenser 133 having a laterally extending powder discharge slit is provided in the winding section 112 for applying the powder adhesive to only a predetermined length of the leading portion of the web such that the wound web R around each of the cores Q has an inner portion adjacent to the core Q bearing the powder adhesive.

After a predetermined length of the web $T_2$ has been wound around each of the cylindrical core Q, the winding section 112 stops the winding operation and the shaft V having the wound web-bearing cores P is displaced to a receiving section 114 where the trailing end of each of the wound webs is cut and is bonded to the wound web with an adhesive in any known manner. The resulting assembly Y which consists of the shaft V, the cores Q supported on the shaft V by stopper caps $W_1$ and $W_2$, and wound webs R formed around respective cores Q is displaced on the conveyer 117 and is introduced into the separating device 102 (FIG. 1) where one or both caps $W_1$ and $W_2$ are detached and the shaft V is pulled out of the assembly Y in any suitable manner to leave an array Z of wound web-bearing cores P. The array Z is fed to a heating zone to fuse the powder adhesive and to integrally bind the inner region of the wound web R. Thereafter, the core Q is separated from the wound web R in the same manner as described in the previous embodiment.

What is claimed is:

1. A process for the production of a cylindrical roll of toilet paper having a predetermined length, comprising:

mounting a plurality of cylindrical cores on a single shaft so that said cylindrical cores are in an axially aligned array on said shaft, each of said cylindrical cores having a fixed outer diameter which is substantially the same as the inside diameter of the roll and having an axial length substantially equal to that of the roll;

winding a continuous toilet paper web of said predetermined length around each of said cylindrical cores and applying a liquid to only a leading portion of said web so that each wound web has a wet inner portion adjacent the core;

extracting said shaft from said cylindrical cores to leave an array of axially aligned cores each bearing a wound web;

then, while maintaining said cylindrical cores in said axially aligned array, drying said wet, inner portion of each wound web to integrally bind said inner portion; and then separating said core from each of said wound webs.

2. A process according to claim 1, wherein said drying step includes permitting said inner portion around each of said cores to stand in air for a period of time sufficient to dry said inner portion.

3. A process according to claim 1, wherein said drying step comprises heating air and contacting each of said wound webs with the heated air.

4. A process according to claim 3, wherein said core is a perforated cylinder and wherein said drying step is performed by feeding said heated air through said perforated cylinder.

5. A process for the production of a roll of toilet paper having a predetermined length, comprising:

fitting a plurality of cylindrical cores on a single shaft so that said cylindrical cores are in an axially aligned array on said shaft, each of said cylindrical cores having a fixed outer diameter which is substantially the same as the inside diameter of the roll and having an axial length substantially equal to that of the roll;

winding a continuous toilet paper web of said predetermined length around each of said cylindrical cores and applying a fusible powder adhesive to only a leading portion of said web so that each wound web has an inner portion adjacent said core which bears said powder adhesive;

then heating each of said wound webs to fuse said powder adhesive and to integrally bind said inner portion; and then separating said cores from each of said wound webs.

* * * * *